US005875372A

United States Patent [19]

Sato et al.

[11] Patent Number: 5,875,372

[45] Date of Patent: Feb. 23, 1999

[54] IMAGE FORMING APPARATUS

[75] Inventors: Yotaro Sato; Kunio Shigeta; Satoshi Haneda; Akitoshi Matsubara; Tadayoshi Ikeda; Masakazu Fukuchi, all of Hachioji, Japan

[73] Assignee: Konica Corporation, Tokyo, Japan

[21] Appl. No.: 892,531

[22] Filed: Jul. 14, 1997

[30] Foreign Application Priority Data

Jul. 26, 1996 [JP] Japan ..... 8-197496
Aug. 26, 1996 [JP] Japan ..... 8-223832

[51] Int. Cl.[6] ..... G03G 15/20

[52] U.S. Cl. ..... 399/67; 399/69; 399/320

[58] Field of Search ..... 399/33, 38, 39, 399/46, 67, 68, 69, 70, 297, 298, 302, 303, 306, 309, 312, 330

[56] References Cited

U.S. PATENT DOCUMENTS

| | | | |
|---|---|---|---|
| 4,737,818 | 4/1988 | Tanaka et al. | 399/70 |
| 5,051,780 | 9/1991 | Stelter et al. | 399/70 |
| 5,124,756 | 6/1992 | Stelter | 399/69 |
| 5,162,859 | 11/1992 | Hirono et al. | 399/297 X |
| 5,329,343 | 7/1994 | Saito | 399/70 |

FOREIGN PATENT DOCUMENTS

| | | |
|---|---|---|
| 3717984 A1 | 12/1987 | Germany . |
| 49-37538 | 10/1974 | Japan . |
| 54-28740 | 9/1979 | Japan . |
| 1-44457 | 2/1989 | Japan . |
| 3-171390 | 7/1991 | Japan . |
| 4-214576 | 8/1992 | Japan . |

*Primary Examiner*—Arthur T. Grimley
*Assistant Examiner*—Hoan Tran
*Attorney, Agent, or Firm*—Frishauf, Holtz, Goodman, Langer & Chick

[57] ABSTRACT

An image forming apparatus includes a first image carrier on which a toner image forming device forms a toner image; a second image carrier provided opposite to the first image carrier, onto which the toner image on the first image carrier is transferred; first and second transfer devices for transferring the toner image on the first and second image carriers onto one side and the other side of a transfer material, respectively; and a fixing device for fixing the toner images on both sides of the transfer material transferred respectively by the first and second transfer devices. The fixing device includes first and second fixing members provided opposite to one side and the other side of the transfer material, respectively, wherein the transfer material passes between the first and second fixing members, and first and second sensors are provided for detecting temperature of the first and second fixing members respectively. The apparatus further includes a control device for controlling the toner image forming device, the first and second transfer devices, and the fixing device. The control device enables image formation on both sides of the transfer material or on one side of the transfer material, and prohibits image formation on at least both sides of the transfer material when the temperature detected by the first sensor is appropriate for the first fixing member, and the temperature detected by the second sensor is not appropriate for the second fixing member.

6 Claims, 19 Drawing Sheets

UPPER ROLLER TEMP.(TU)
TEMP.
TU
TUL
0
TIME

LOWER ROLLER TEMP.(TD)
TEMP.
TD
TDL
0
TIME (TU - TUL) VALUE
+
−
TIME (TD - TDL) VALUE
+
−
TIME

AVAILABLE RANGE OF ONE-SIDED AND TWO-SIDED COPY (HATCHED PORTION)
TIME
WARM-UP TIME
POWER SOURCE BUTTON TURNED ON

IMAGE FORMING APPARATUS

BACKGROUND OF THE INVENTION

The present invention relates to an image forming apparatus, and more particularly, to an image forming apparatus capable of performing one-sided copying or two-sided copying on a transfer sheet.

There has so far been available an image forming apparatus wherein a toner image formed on an image forming object is transferred onto the obverse side of a transfer sheet, and an image formed on the image forming object is temporarily transferred onto a toner image receptor and then is transferred onto the reverse side of the transfer sheet, and the toner images thus transferred onto the transfer sheet are collectively fixed by a first fixing means and a second fixing means, so as to perform two-sided copying. There has been disclosed a technology to heat by independently setting temperatures respectively for the first fixing means and the second fixing means, for example, in the above-mentioned apparatus (Japanese Patent Publication Open to Public Inspection No. 171390/1991 (hereinafter referred to as Japanese Patent O.P.I. Publication)).

The invention further relates, in particular, to an image forming apparatus wherein toner images are formed on both sides of a transfer material, and these images are collectively heated and fixed for two-sided image formation.

In two-sided copying, the conventional technique has been a method wherein an image on one side of an original formed on an image forming object is transferred and fixed on a transfer material which is then stored temporarily in an intermediate tray, and the transfer material is fed out of the intermediate tray in synchronization with an image on the other side of the original formed subsequently on the image forming object, so that the image on the other side of the original may be transferred and fixed on the other side of the transfer material.

In the two-sided copying apparatus mentioned above, a transfer material is fed to the intermediate tray and is caused to pass through a fixing unit twice, as stated above. Therefore, a conveyance distance for a transfer material is long, which causes a long processing time for copying, and reliability for conveyance of a transfer material is low because a transfer material which has passed through the fixing unit once to be ready for curling is conveyed again to pass through the fixing unit, which has been a cause for jamming. To overcome the problems mentioned above, there have been proposed technologies to form toner images on both sides of a transfer material and to fix them at the same time in Japanese Patent Examined Publication Nos. 37538/1974 and 28740/1979, and Japanese Patent O.P.I. Publication Nos. 44457/1989 and 214576/1992.

In ordinary image formation, however, frequency of image forming on one side of a transfer material (one-sided copy mode) is high, and when copies are made continuously, a temperature of a fixing roller is gradually lowered. In this case, a temperature of a fixing roller facing the opposite side (rear side) of the surface on which toner images are formed is also lowered because a transfer material passing through the fixing unit takes heat away. Therefore, when image formation on both sides of a transfer material (two-sided copy mode) is designated, and two-sided copying is executed without taking any action, insufficient fixing for images on the reverse side is unavoidable. Due to that, toner images fixed imperfectly are ejected out, soiling the hands of a user and soiling other copies with toner images moved to other transfer materials, which is a problem.

A first object of the invention is to solve the problem mentioned above.

Since the fixing roller of the first fixing means and that of the second fixing means in the prior art are independently subjected to temperature setting and are independently heated, when both fixing rollers are used in two-sided copying, after heating the fixing roller on the side facing visible images on a one-sided copy in one-sided copying, for example, heating efficiency is poor and heating time is long because the fixing roller is heated independently.

The invention has been achieved in view of the aforesaid problem, and its second object is to provide an image forming apparatus wherein the heating time for a fixing roller is short, heating efficiency is excellent, and idling time for fixing is made to be shortest in each of one-sided copy mode and two-sided copy mode, or idling time for fixing in two-sided copy mode and that in one-sided copy mode are standardized.

However, it is not easy to collectively fix a transfer material having toner images on its both sides. For the purpose of fixing collectively the transfer material having toner images on its both sides, it is necessary to arrange heating means over both sides of the transfer material, and power consumption at the fixing means is inevitably high because power needs to be supplied to both heating means. However, a reduction of power consumption has not heretobefore been proposed. Further, an increase in power consumption causes a rise in temperature of an apparatus, resulting in occurrence of a change in characteristics of a photoreceptor and other troubles, thus, excellent images can not be formed and an operation expense for the apparatus is increased, which has been a problem.

A third object of the invention is to provide an image forming apparatus wherein the problem mentioned above has been solved, and both a transfer material having toner images on its both sides and a transfer material having a toner image on its one side can be fixed excellently with less power consumption.

SUMMARY OF THE INVENTION

The first object mentioned above can be attained by an image forming apparatus having therein, a first image carrier; a toner image forming means which forms a toner image on the first image carrier; a second image carrier which is arranged to face the first image carrier so that the toner image on the first image carrier may be transferred and held thereon; a first transfer means that transfers the toner image formed on the first image carrier onto one side of a transfer material; a second transfer means that transfers the toner image held on the second image carrier onto the other side of the transfer material; a fixing means which fixes the toner on the transfer material onto both sides of which the toner images have been transferred by the first and second transfer means, the fixing means having a first fixing member facing one side of the transfer material and a second fixing member facing the other side of the transfer material, and the transfer material passing between the first fixing member and the second fixing member, and further the fixing means having a first sensor for detecting temperature of the first fixing member and a second sensor for detecting temperature of the second fixing member; and a control means that controls the toner image forming means, the first transfer means, the second transfer means and the fixing means, the control means making image formation on both sides of the transfer material possible, and making image formation on one side of the transfer material possible, and the control means prohibits image formation on at least both sides of the transfer material when the first predetermined temperature detected by the first sensor is appropriate for the established temperature of the first fixing member, and the second predetermined temperature detected by the second sensor is not appropriate for the established temperature of the second fixing member.

DETAILED DESCRIPTION OF THE PREFERRED EMBODIMENT

EXAMPLE 1

Figure 1:
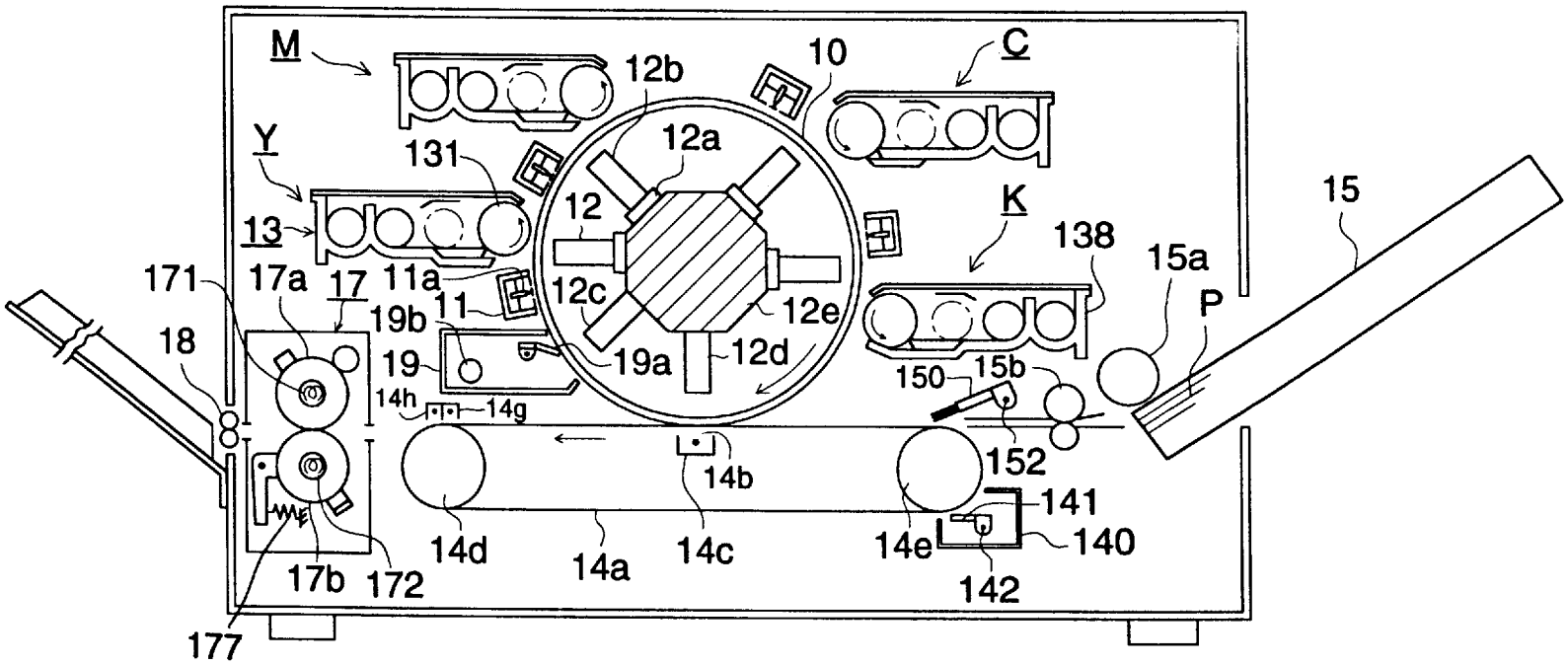
FIG. 1 is a schematic section of an image forming apparatus showing Example 1 that attains the first and second objects.
Figure 2:
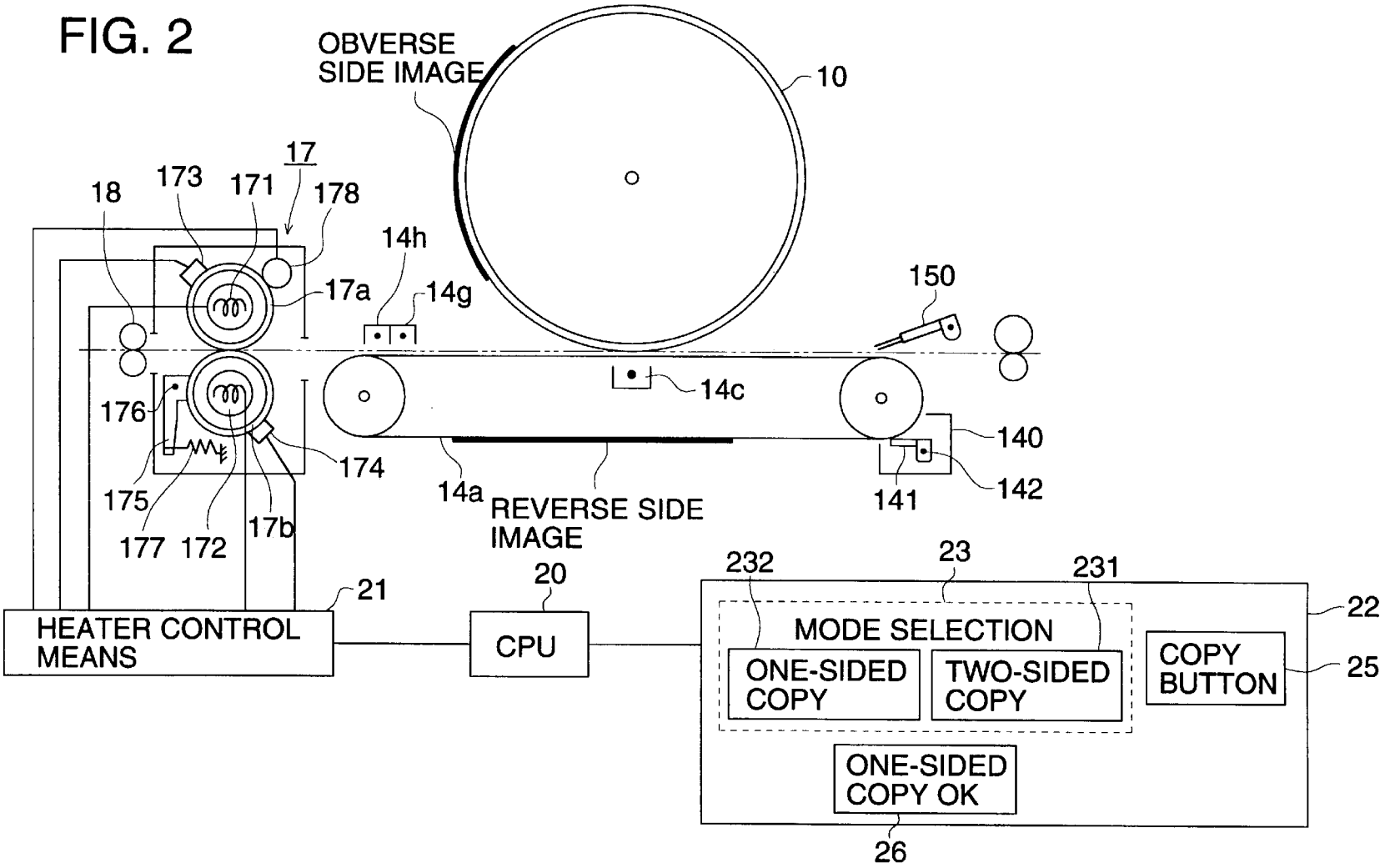
FIG. 2 is a schematic section of primary portions of the image forming apparatus of Example 1.
Figure 3:
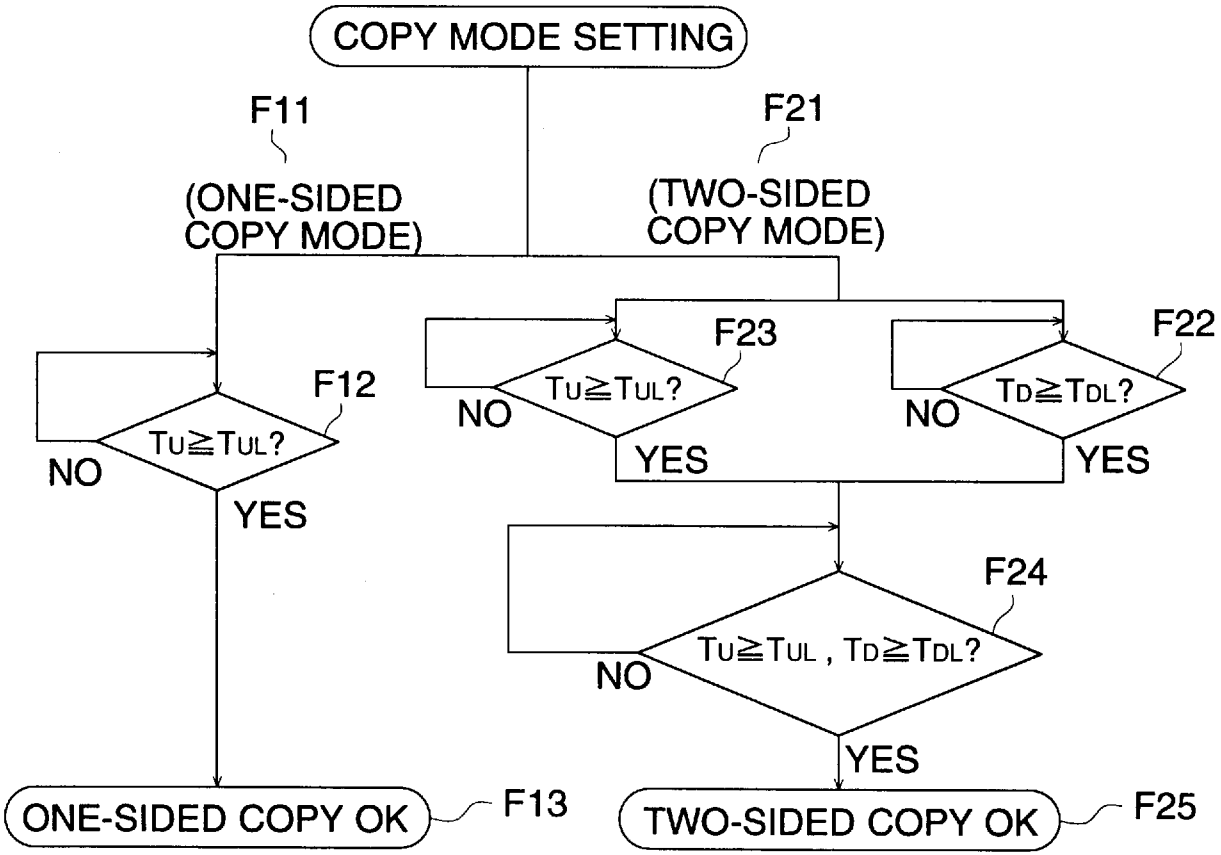
FIG. 3 is a flow chart diagram for judging whether it is possible to copy or not in Example 1.
Figure 4:
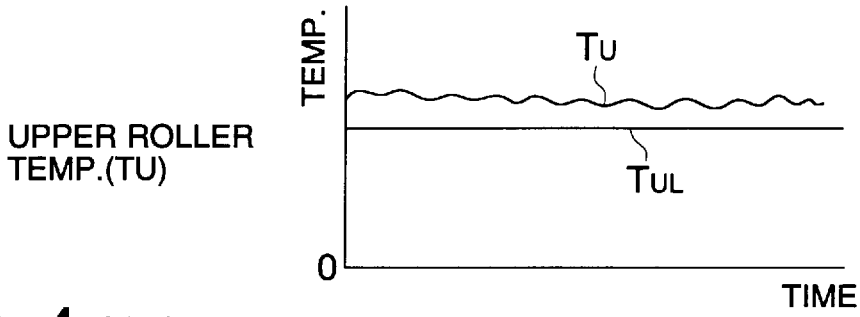
FIGS. 4(*a*)–4(*e*) represent an illustration for operations in Example 1.
Figure 4:
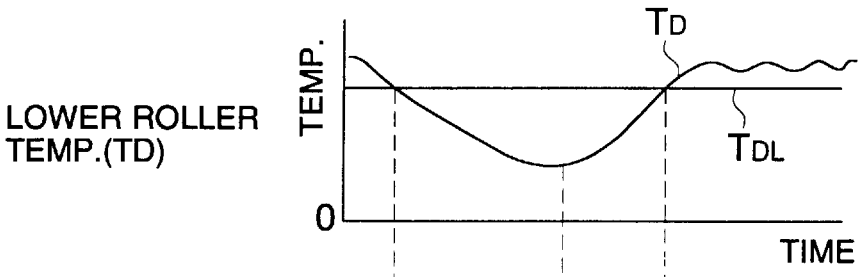
Figure 4:
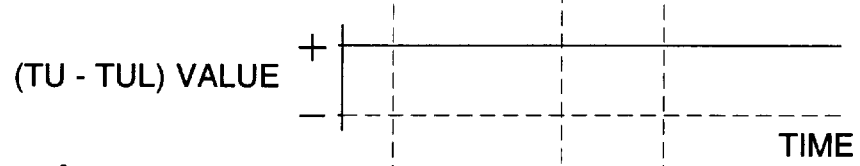
Figure 4:
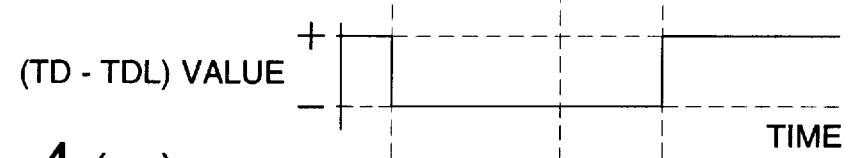
Figure 4:
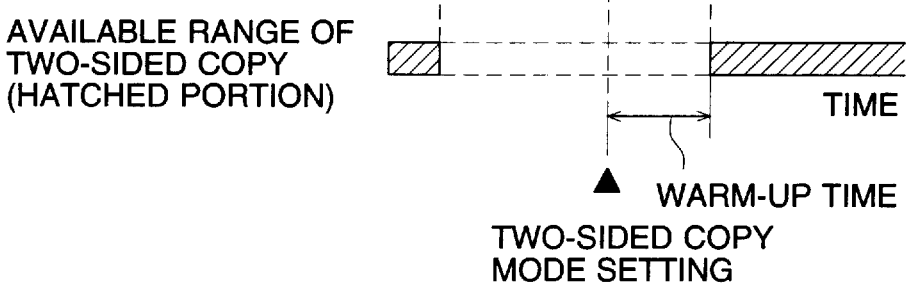

An image forming apparatus in the example attaining the first and second objects will be explained, referring to the drawings. FIG. 1 is a schematic section of an image forming apparatus showing Example 1, FIG. 2 is a schematic section of primary portions of the image forming apparatus of Example 1, FIG. 3 is a flow chart diagram for judging whether it is possible to copy or not in the Example 1, and FIGS. 4 represents an illustration for operations of the apparatus.

In illustration of overall structure of the image forming apparatus in FIG. 1, photoreceptor drum 10 is an image carrier which is, for example, an object having inside thereof a cylindrical base composed of a transparent member and having on the circumferential surface of the base a transparent conductive layer and a photosensitive layer such as an a-Si (amorphous silicon) layer or an organic photoconductor layer, and being rotated in the arrowed direction. Scorotron charging unit 11 serving as a charging means is used for an image forming process for each color of yellow (Y), magenta (M), cyan (C) and black (K), and is mounted in such a way as to face the photoreceptor drum 10 in the direction perpendicular to the moving direction of the photoreceptor drum 10. The scorotron charging unit 11 charges an organic photoconductor layer of the photoreceptor drum 10 by means of a control grid kept at a prescribed voltage and discharge electrode 11*a* for corona discharge in the same polarity as toner, to give uniform potential to the photoreceptor drum 10.

Exposure unit 12 for each color is located so that an exposure position on the photoreceptor drum 10 may be set between the scorotron charging unit 11 and developing unit 13 and on the upstream side in terms of rotation of the photoreceptor drum for developing sleeve 131. The exposure unit 12 is structured as a unit for exposure wherein exposure element 12*a* composed of plural LEDs (light-emitting diodes) each being arranged in the direction of primary scanning that is in parallel with the axis of the photoreceptor drum 10, arranged in a form of an array, and SELFOC lens 12*b* serving as a full-scale imaging element are mounted on holding member 12*e*. The holding member 12*e* provided with exposure unit 12 for each color, unit for uniform exposure 12*c* and with transfer-overlapping exposure unit 12*d* is incorporated inside the base of the photoreceptor drum 10.

With regard to the developing unit 13, developing units for yellow (Y) and magenta (M) are arranged on the left side of the photoreceptor drum 10 in terms of its rotation direction, while developing units for cyan (C) and black (K) are arranged on the right side of the photoreceptor drum 10. Scorotron charging units 11 for Y and M are arranged under developing casing 138 for developing units 13 for Y and M, while scorotron charging units 11 for C and K are arranged over developing casing 138 for developing units 13 for C and K. Developing unit 13 for each color contains single-component or two-component developing agent of yellow (Y), magenta (M), cyan (C) or black (K), and is provided with developing sleeve 131 made of aluminum which is kept to be distant by a prescribed gap from the circumferential surface of the photoreceptor drum 10 and is rotated in the same direction as that of the photoreceptor drum 10 in the developing position. Further, the developing unit 13 is kept to be away from the photoreceptor drum 10 by a gap of prescribed distance by an unillustrated stopper roll, and developing bias to which DC voltage is added, or developing bias to which DC voltage and alternating voltage AC are added is impressed on the developing sleeve 131 so that jumping development by means of single-component or two-component developing agent contained in the developing unit may be carried out, and DC bias with the same polarity as that of toner is impressed on the negatively charged photoreceptor drum 10 whose transparent conductive layer is grounded, thus, toner is stuck to the exposed portion.

An electrostatic latent image formed on the photoreceptor drum 10 through charging by means of scorotron charging unit 11 and imagewise exposure by means of exposure unit 12 is subjected to reversal development conducted by the developing unit 13 for each color with toner having the same polarity as charging polarity under the non-contact state made by impression of developing bias voltage. An original image read by an image-pickup element of an image reading device that is separate from the present apparatus, or an image compiled by a computer is temporarily stored, as an original image, in a memory to be housed as image data for each color of Y, M, C and K. When an unillustrated photoreceptor driving motor is started at the start of image recording, giving of potential to the photoreceptor drum 10 is started by simultaneous charging operation made by scorotron charging unit 11 for Y located on the left side of the photoreceptor drum 10 and below developing casing 138 of developing unit 13 for yellow (Y). After being given potential, the photoreceptor drum 10 is subjected to the start of exposure of electric signals corresponding to image data for Y in exposure unit 12 for Y, whereby electrostatic latent images corresponding to images for Y in the original image are formed on the photosensitive layer of the drum through rotary scanning of the drum.

The electrostatic latent image mentioned above is subjected to reversal development conducted by developing unit 13 for Y on condition that developing agents on a developing sleeve do not touch the electrostatic latent image, and a toner image in yellow (Y) is formed as the photoreceptor drum 10 rotates. Then, the photoreceptor drum 10 is given potential on the toner image in yellow (Y) by charging operation of scorotron charging unit 11 for magenta (M) located below developing casing 138 of developing unit 13 for magenta (M), and the photoreceptor drum 10 is subjected to exposure by means of electric signals corresponding to image data for M of exposure unit 12 for M. Then, a toner image in magenta (M) is formed to be superposed in succession on the aforesaid toner image in yellow (Y) through non-contact reversal development conducted by developing unit 13 for M.

In the same process, a toner image in cyan (C) is formed to be superposed by scorotron charging unit 11 for cyan (C) located above developing casing 138 of developing unit 13 for cyan (C) on the right side of the photoreceptor drum 10, exposure unit 12 for cyan (C) and by developing unit 13 for cyan (C), and a toner image in black (K) is formed to be superposed by scorotron charging unit 11 for black (K) located below cyan (C) and above developing casing 138 of developing unit 13 for black (K) on the right side of the photoreceptor drum 10, exposure unit 12 and by developing unit 13, thus, a color toner image of reverse side image is formed on the photoreceptor drum 10. In transfer area 14, the superposed color toner image is spread between driving roller 14*d* and driven roller 14*e* by transfer unit 14*c* that is to be impressed with voltage having polarity opposite to that of toner, and is transferred collectively onto toner image receiving body 14*a* provided to be close to or to be in contact with the photoreceptor drum 10. For the better transfer, in this case, uniform exposure is conducted by transfer-overlapping exposure unit 12*d* employing, for example, light-emitting diode (second image forming means).

Then, in the same way as in the aforesaid color image forming process, a superposed color toner image of yellow (Y), magenta (M), cyan (C) and black (K) for an obverse side image is formed on the photoreceptor drum 10 (first image forming means).

In this case, recording sheet P is fed out of sheet-feeding cassette 15 by feed-out roller 15*a,* and is conveyed to timing roller 15*b*. The recording sheet P is fed to transfer area 14*b* by the timing roller 15*b,* with a color toner image representing the obverse side image carried on the photoreceptor drum 10 and a color toner image representing the reverse side image carried on the toner image receiving body 14*a* synchronized with each other. In this case, recording sheet P is sheet-charged to be of the same polarity as toner by sheet-charging unit 150 which can be rotated to be brought into contact with toner image receiving body 14*a* or can be released from contact with toner image receiving body 14*a* on supporting shaft 152 serving as a fulcrum for rotation and has a brush-shaped tip which is brought into contact with the recording sheet P, and thereby attracted to the toner image receiving body 14*a* to be conveyed to transfer area 14*b*. Incidentally, sheet-charging the recording sheet P to be in the same polarity as toner prevents the recording sheet P from attracting a toner image on the toner image receiving body and a toner image on the image carrier so that disturbance of the toner image may be prevented. Simultaneously with passage of the recording sheet P, the sheet-charging unit 150 is separated from the toner image receiving body 14*a* to be released from the contact.

Obverse side images on the circumferential surface of the photoreceptor drum 10 are collectively transferred onto the upper surface side (obverse surface side) of the recording sheet P by transfer unit 14*c* which is impressed with voltage having polarity opposite to that of toner. In this case, the reverse side image on the circumferential surface of the toner image receiving body 14*a* is not transferred onto the recording sheet P but stays on the toner image receiving body 14*a*. Then, reverse side images on the circumferential surface of the toner image receiving body 14 are collectively transferred onto the lower surface side (reverse surface side) of the recording sheet P by reverse side transfer unit 14*g* impressed with voltage having polarity opposite to that of toner.

The recording sheet P having color toner images on its both sides is neutralized by AC neutralizing unit 14*h* that is for separation of a transfer sheet, and then is separated from toner image receiving body 14*a* to be conveyed to fixing unit 17. In this fixing unit, heat and pressure are applied on the recording sheet P that is sandwiched between upper roller 17*a* and lower roller 17*b* both represent a fixing member, whereby toner sticking to each of the obverse side and reverse side of the recording sheet P is fixed, thus the recording sheet P is conveyed by sheet-ejecting roller 18 to be delivered onto a tray located outside the apparatus. Incidentally, the fixing unit 17 will be explained in detail later, referring to FIG. 2.

Toner remaining, after transferring, on the circumferential surface of the toner image receiving body 14*a* is removed by toner image receiving body cleaning blade 141 which can be rotated to be brought into contact with toner image receiving body 14*a* or can be released from contact with toner image receiving body 14*a* on supporting shaft 142 serving as a fulcrum for rotation. On the other hand, toner remaining, after transferring, on the circumferential surface of the photoreceptor drum 10 is scraped off by cleaning blade 19*a* of cleaning unit 19. The photoreceptor drum 10 cleaned by the cleaning unit 19 to be free from remaining toner is subjected to uniform charging conducted by scorotron charging unit 11 for Y to be ready for the succeeding image forming cycle.

In FIG. 2, fixing unit 17 that is a fixing means applies heat and pressure on the obverse side and reverse side of the recording sheet P having toner images sticking thereto, and fixes the toner images on the recording sheet P. The fixing unit 17 is provided with upper roller 17*a* and lower roller 17*b*, and the upper roller 17*a* is rotated by motor 178 through its rotation, while the lower roller 17*b* is rotated by the rotation of the upper roller 17*a*. Further, the upper roller 17*a* is provided on its surface with upper thermistor 173 which detects a temperature of the upper roller 17*a*. In the same way, the lower roller 17*b* facing the reverse side of a transfer sheet is urged by spring 177 mounted on lever 175 that rotates freely around supporting shaft 176, so that the lower roller 17*b* may be brought into pressure contact with the upper roller 17*a* to be rotated. Inside the lower roller 17*b*, there is provided lower heater 172 which heats the lower roller 17*b*. Further, the lower roller 17*b* is provided on its surface with lower thermistor 174 which detects a temperature of the lower roller 17*b*.

In the fixing unit 17, when there is a temperature difference between the upper roller and the lower roller, heat conduction is carried out between both rollers while they are rotating. For example, when a temperature of the lower roller is lower than a prescribed temperature range, the lower roller is heated by both the lower heater 172 owned by the lower roller itself and heat conduction effected by the rotation of the upper roller, so that the heating time may be shortened by excellent heat efficiency.

Heater control means 21 is a means to control the fixing unit 17, and it controls ON and OFF for upper heater 171 and lower heater 172 both representing a heating means, in accordance with temperatures detected by upper thermistor 173 and lower thermistor 174. It also controls motor 178 in terms of driving the same.

Operation panel 22 is provided with an operation button to operate an apparatus and with a display. Mode selection 23 includes two-sided copy mode key 231 and one-sided copy mode key 232, and the two-sided copy mode key 231 selects a two-sided copy mode, while the one-sided copy mode key 232 selects a one-sided copy mode. Copy button 25 is a button used for copying. Display 26 displays completion of warming-up for the two-sided copy mode or the one-sided copy mode. CPU 20 is a computer that controls an apparatus on a sequential basis, or controls each driving portion.

Next, in FIG. 3, where will be explained a method to judge whether COPY is OK or not in the example. When ONE-SIDED COPY MODE is selected in copy mode selection (F 11), judgment of whether ONE-SIDED COPY is OK or not is started, and it is checked whether the condition of upper roller temp. $T_U \geqq$upper roller threshold value temp. $T_{UL}$ is satisfied or not (F 12). When the above condition is not satisfied, heating of the upper roller is continued, while when that condition is satisfied, ONE-SIDED COPY OK signals are sent out (F 13). Incidentally, the upper roller threshold value temp. means a lower limit temp. in a range of temperatures to be set for the upper roller.

When TWO-SIDED COPY MODE is selected (F 21), it is checked whether the condition of upper roller temp. $T_U \geqq$upper roller threshold value temp. $T_{UL}$ is satisfied or not (F 23). When the above condition is not satisfied, heating of the upper roller is continued while it rotates, and when that condition is satisfied, the sequence enters next checking (F 23). Then, it is checked whether the condition of lower roller temp. $T_D \geqq$lower roller threshold value temp. $T_{DL}$ is satisfied or not (F 22). When the above condition is not satisfied, heating of the lower roller is continued while it rotates, and when that condition is satisfied, the sequence enters a next checking phase wherein it is checked whether the upper roller temp. $T_U \geqq$upper roller threshold value temp. $T_{UL}$, and whether the lower roller temp. $T_D \geqq$lower roller threshold value temp. $T_{DL}$ (F 24), and when the conditions are satisfied, TWO-SIDED COPY OK signals are sent out (F 25). Incidentally, the lower roller threshold value temp. $T_{DL}$ is a lower limit temp. in a range of temperatures to be set for the lower roller.

Explanation of Operation Examples

Now, an example of copying operations of an image forming apparatus in the example will be explained as follows, referring to FIG. 1–FIG. 4(*e*). FIG. 4(*a*) shows upper roller temperature $T_U$, FIG. 4(*b*) shows lower roller temperature $T_D$, FIG. 4(*c*) shows the state of upper roller temp. $T_U \geqq$upper roller threshold value temp. $T_{UL}$, FIG. 4(*d*) shows the state of lower roller temp. $T_D \geqq$lower roller threshold value temp. $T_{DL}$, and FIG. 4(*e*) shows the relation between the range of TWO-SIDED COPY OK and its time.

First, an unillustrated main switch of the apparatus is turned on, whereby upper heater 171 and lower heater 172 are turned on as shown in FIG. 2. Then, continuous copying is conducted under the ONE-SIDED COPY MODE. In this case, the lower heater 172 is kept to be turned off in the course of copying, because an unfixed image exists only on the side of the upper roller 17*a*. As time passes, therefore, temperature $T_D$ of the lower roller 17*b* is lowered, and its temperature is lower than the temperature set when copying is completed (see FIG. 4(*b*)).

Under this condition, TWO-SIDED COPY MODE key 231 on operation panel 22 is operated for inputting as shown in FIG. 2. In the case of two-sided copying wherein unfixed images exist on both sides of a transfer sheet, when the temperature of lower roller 17*b* is low, reverse side images can not be fixed sufficiently. Therefore, when TWO-SIDED COPY MODE is inputted, copying is prohibited until both the upper roller temp. $T_U \geqq$upper roller threshold value temp. $T_{UL}$, and the lower roller temp. $T_D \geqq$lower roller threshold value temp. $T_{DL}$. Then, warming-up is completed when the aforesaid conditions are satisfied to become the state of TWO-SIDED COPY OK (see FIG. 4(*e*)). Now, copy button 25 can be pressed for two-sided copying.

Incidentally, when obtaining the same fixing efficiency for the obverse side and the reverse side of a transfer sheet, the condition of $T_U - T_D \leqq 15°$ C. is preferable under the assumption that $T_U$ represents upper roller temperature and $T_D$ represents lower roller temperature.

EXAMPLE 2

Figure 5:
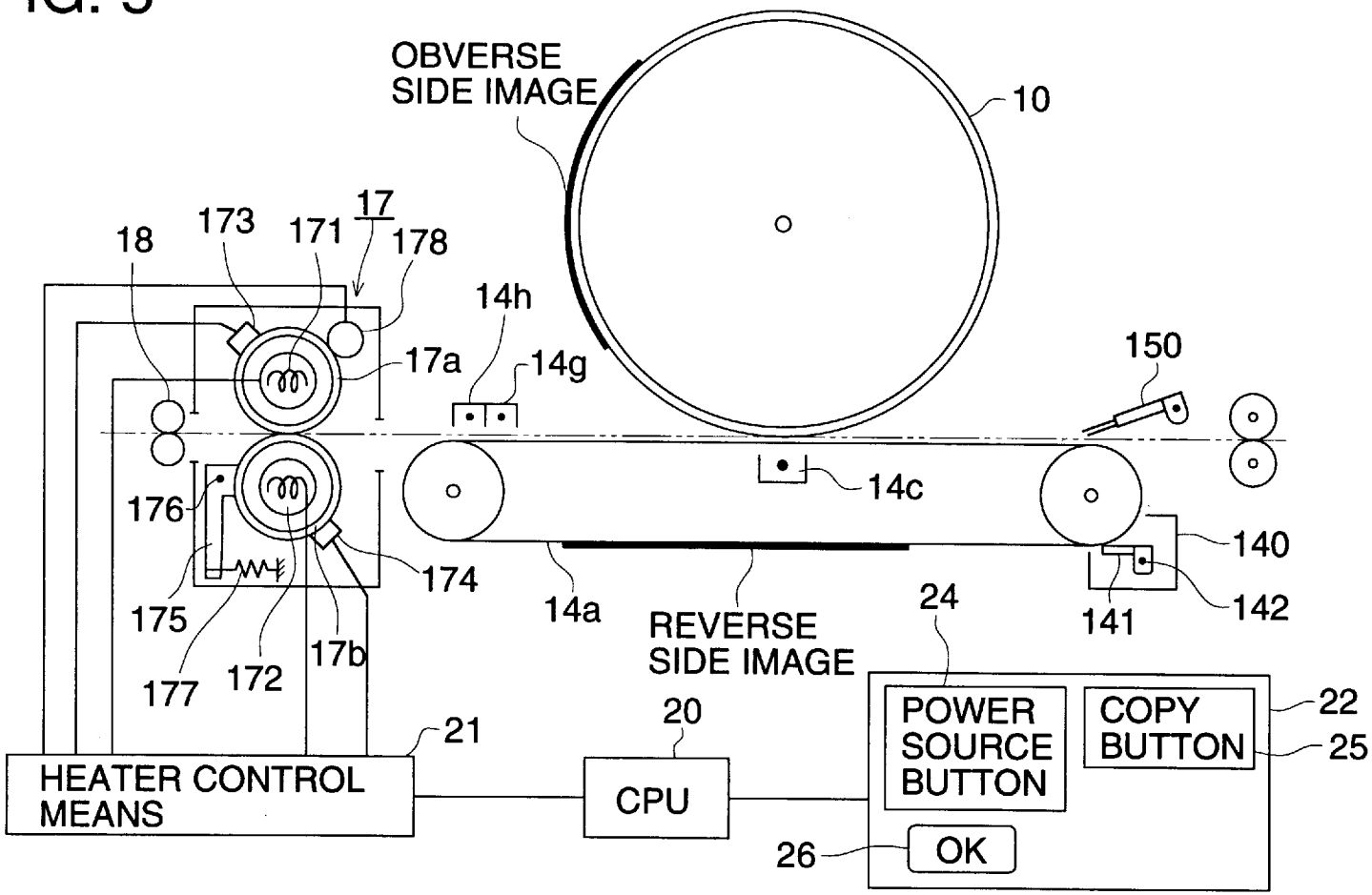
FIG. 5 is a schematic section of primary portions of an image forming apparatus of Example 2 that attains the first and second objects.
Figure 6:
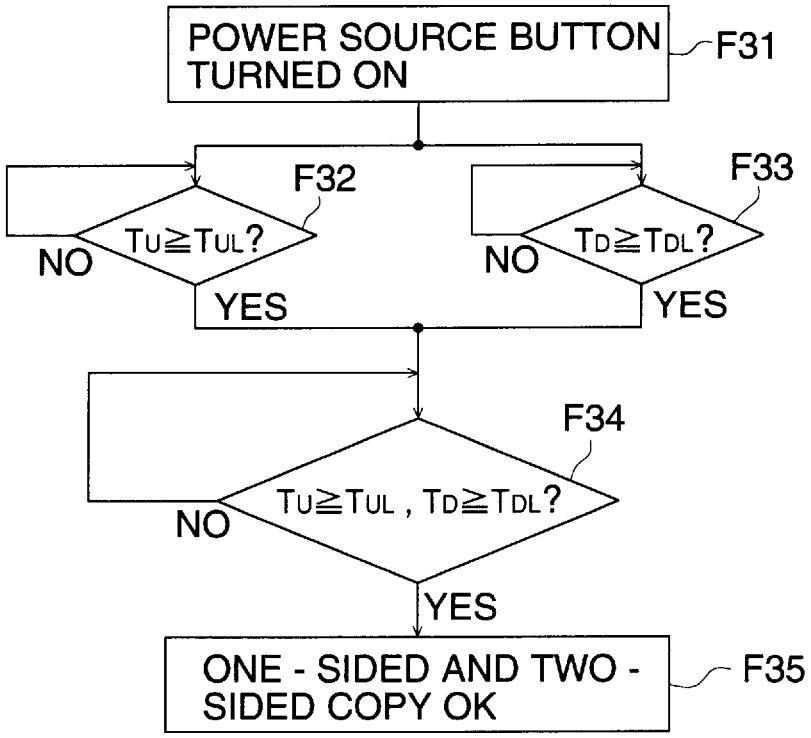
FIG. 6 is a flow chart diagram for judging whether it is possible to copy or not in Example 2.
Figure 7:
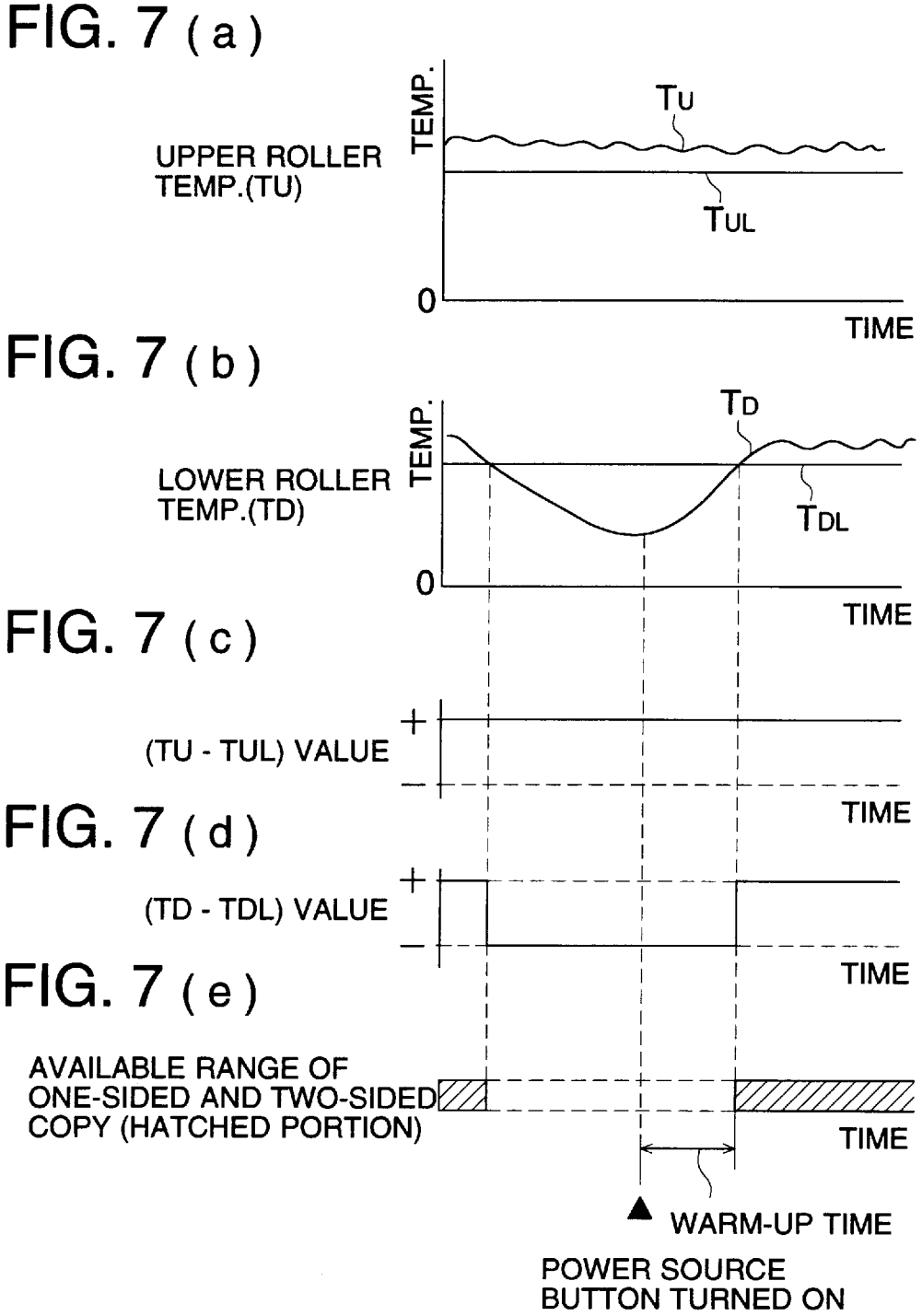
FIGS. 7(*a*)–(*e*) represent an illustration for operations in Example 2.

Next, an image forming apparatus in the example attaining the first and second objects will be explained as follows, referring to the drawings. FIG. 5 is a schematic section of primary portions of the image forming apparatus in Example 2, FIG. 6 is a flow chart for judging whether copying is possible or not in Example 2, and FIG. 7 is an illustration of operations in Example 2. Incidentally, the overall structure of the image forming apparatus in the example is not explained here because it is not changed in terms of mechanism from that in FIG. 1 explained in Example 1.

When explaining in FIG. 5, focusing on portions which are different from those in FIG. 2 explained above, operation panel 22 has thereon an operation button to operate an apparatus, and a display. Power source button 24 is a key to start warming-up, copy button 25 is a button to start copying. Display 26 displays completion of warming-up. Incidentally, CPU 20 is a computer which controls an apparatus on a sequential basis, or controls each driving portion.

A method to judge whether copying is possible or not in the apparatus of the example will be explained as follows, referring to FIG. 6. When power source button 24 is pressed (F 31), judgment of whether copying is possible or not is started, and it is checked whether the condition of upper roller temp. $T_U \geqq$ upper roller threshold value temp. $T_{UL}$ is satisfied or not. When the condition is not satisfied, heating of the upper roller is continued while it rotates, and when that condition is satisfied, the sequence enters next checking (F 32). Further, it is checked whether the condition of lower roller temp. $T_D \geqq$ lower roller threshold value temp. $T_{DL}$ is satisfied or not. When the above condition is not satisfied, heating of the lower roller is continued while it rotates, and when that condition is satisfied, the sequence enters a next checking (F 33) phase wherein it is checked whether the upper roller temp. $T_U \geqq$ upper roller threshold value temp. $T_{UL}$, and whether the lower roller temp. $T_D \geqq$ lower roller threshold value temp. $T_{DL}$ (F 34), and when the conditions are satisfied, ONE-SIDED OK and TWO-SIDED COPY OK signals are sent out (F 35). Then, one-sided copying and two-sided copying are respectively conducted after they become possible.

Explanation of Operation Examples

Copy operation examples of the image forming apparatus in the present example will be explained as follows, referring to FIGS. 5 and 6. FIG. 7(*a*) shows upper roller temperature $T_U$ for the time elapsed, FIG. 7(*b*) shows lower roller temperature $T_D$ for the time elapsed, FIG. 7(*c*) shows the state of upper roller temperature $T_U \geqq$ upper roller threshold value temperature $T_{UL}$ for the time elapsed, FIG. 7(*d*) shows the state of lower roller temperature $T_D \geqq$ lower roller threshold value temperature $T_{DL}$ for the time elapsed, and FIG. 7(*e*) shows an available range of one-sided and two-sided copy for the time elapsed.

First, both upper heater 171 and lower heater 172 are turned on. For making the fixing for both one-sided copying and two-sided copying to be ready, the temperatures of the upper roller and the lower roller are so controlled as to satisfy the conditions of upper roller temperature $T_U \geqq$ upper roller threshold value temperature $T_{UL}$ and lower roller temperature $T_D \geqq$ lower roller threshold value temperature $T_{DL}$. Then, when copying continuously in the one-sided copy mode, the lower heater 172 is kept to be off in the course of copying, because unfixed images exist only on the upper roller 17*a* side. With the lapse of time, therefore, temperature $T_D$ of the lower roller 17*b* is lowered, and its temperature is lower than the temperature of upper roller 17*a* when copying is completed (see FIG. 7(*b*)).

As shown in FIG. 5, when power source button 24 on operation panel 22 is pressed to satisfy the conditions of upper roller temperature $T_U \geqq$ upper roller threshold value temperature $T_{UL}$ and lower roller temperature $T_D \geqq$ lower roller threshold value temperature $T_{DL}$, warming-up is completed to generate the state that makes one-sided copying and two-sided copying possible. Then, copy button 25 is pressed to conduct one-sided copying or two-sided copying.

Incidentally, in the case of one-sided copying again under this condition, fixing is possible as far as the temperature of the upper roller 17*a* is appropriate, but in the case of two-sided copy mode wherein a transfer sheet has on its both sides unfixed images, reverse side images are not fixed sufficiently if the temperature of the lower roller 17*b* is low. In this case, if both one-sided copying and two-sided copying are prohibited so that they may serve as waiting time for warming-up, operations can be simplified from the viewpoint of easy handling, though it is considered that one-sided copying only is made possible by prohibiting two-sided copying.

Incidentally, though the upper roller 17*a* is used for fixing in one-sided copying in Examples 1 and 2, the lower roller 17*b* may also be used in place of the upper roller, depending on the structure of an image forming apparatus.

Due to the arrangement stated above, the following effects are successful. The present invention provides an image forming apparatus wherein the time required for a fixing roller to heat is short, and heating efficiency is excellent. It further provides an image forming apparatus wherein the idling time related to the fixing is shortest in each of the one-sided copy mode and two-sided copy mode. The present invention further provides an image forming apparatus wherein heating efficiency of a fixing roller is high. Furthermore, the invention provides an image forming apparatus wherein idling time related to the fixing in each of the one-sided copy mode and two-sided copy mode is standardized.

Prior to the explanation of the example of the invention for attaining the third object, there will be explained an example which is common to image forming apparatuses wherein the invention is applied and toner images formed on both sides of a sheet are collectively fixed. In the explanation of the example, an obverse side image means an image which is transferred onto the surface on the side facing an image forming object in a transfer area when a color toner image is transferred onto a transfer material, while a reverse side image means an image transferred onto the surface on the other side of the transfer material. Though all of the examples explained below are those of the image forming apparatus that forms a color image, the invention can also be applied to an image forming apparatus for monochromatic images.

Figure 8:
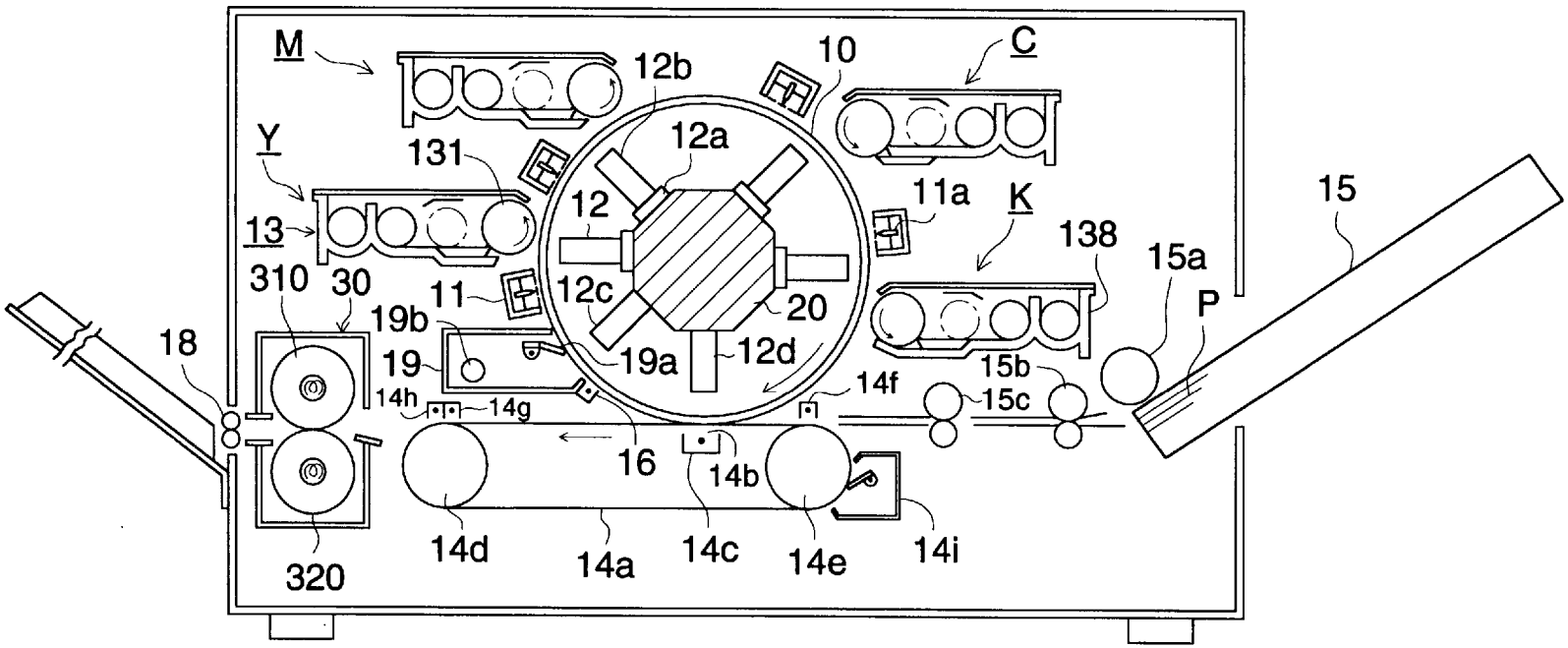
FIG. 8 is a schematic section showing an example of an image forming apparatus that attains the third object of the invention.
Figure 9:
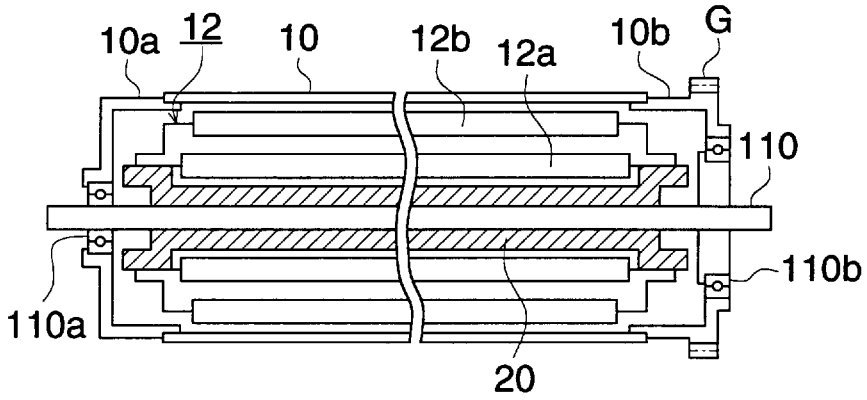
FIG. 9 is a lateral section of the image forming apparatus shown in FIG. 8.
Figure 10:
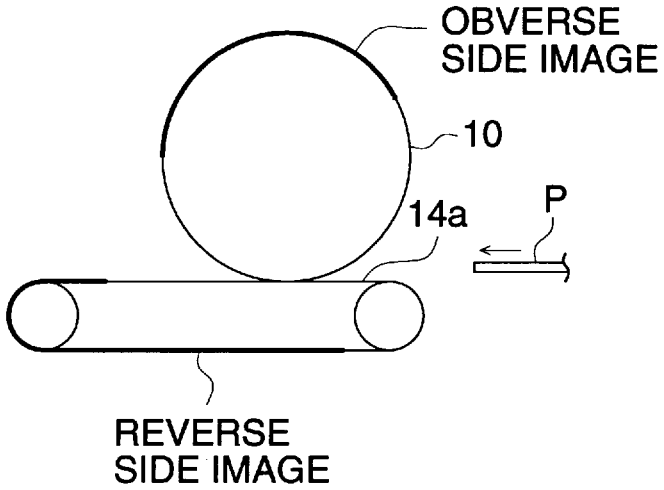
FIG. 10 is an illustration showing how toner images are formed on a two-sided copying basis.

Image forming processes and each mechanism in the example of the image forming apparatus for attaining the third object of the invention will be explained, referring to FIGS. 8–10. FIG. 8 is a schematic section of an example of the image forming apparatus of the invention, FIG. 9 is a side section of the image forming apparatus in FIG. 8, and FIG. 10 is a diagram showing how toner images are formed on both sides in the example. With regard to the schematic section in FIG. 8, explanation will be made, focusing on points which are different from those in FIG. 1.

With regard to photoreceptor drum 10 shown in FIG. 8, flange members 10*a* and 10*b* at both ends of the drum which combine and fix the drum are supported rotatably on drum shaft 110 fixed on the apparatus main body through bearings 110*a* and 110*b* which are fitted respectively in the flange members 10*a* and 10*b* at both ends, whereby the photoreceptor drum is rotated at the constant speed in the prescribed direction when gear G formed integrally on the flange member 10*b* is engaged with a driving gear on the apparatus main body to be driven.

As a light-emitting element other than the LEDs used in exposure unit 12, there are used those wherein a plurality of light-emitting elements such as FL (fluorescent body luminescence), EL (electro-luminescence) and PL (plasma discharge) are arranged in a form of an array. A luminescence wavelength of a light-emitting diode used in the present example which is within a range of 680–900 nm having high transmittance against toner for Y, M and C is preferable, but the wavelength shorter than this which is not sufficiently transparent for color toner is also acceptable because of imagewise exposure made from the inside (reverse side) of photoreceptor drum 10.

Being synchronized with a reverse side image formed on toner image receiving body 14*a* in transfer area 14*b,* an obverse side image of the superposed color toner image is formed on photoreceptor drum 10 in the same manner as in the aforesaid color image forming process. FIG. 10 shows how toner images for both the reverse image formed on the toner image receiving body 14*a* and the obverse image to be formed on the photoreceptor drum 10 are formed. Incidentally, it is necessary to modify the image data so that the obverse side image formed in this case and the reverse side image formation may be on the relation of a reflected image each other on the photoreceptor drum 10.

Since a toner image of each color is superposed on others, it is preferable for the collective transfer that the uppermost layer and the lowermost layer of the toner layer are charged equally in terms of a quantity of charge and polarity. From a viewpoint of the aforesaid statement, in two-sided image formation wherein a color toner image formed on toner image receiving body 14*a* is subjected to polarity reversing carried out by corona charging and a color toner image formed on photoreceptor drum 10 is subjected to polarity reversing carried out by corona charging, toner in a lower layer is not charged to the same polarity, resulting in insufficient transfer, which is not preferable.

It is preferable that reversal development is repeated on photoreceptor drum 10, and superposed color toner images each having the same polarity thus formed are collectively transferred onto toner image receiving body 14*a* without being changed in terms of polarity, to be further transferred collectively onto recording sheet P without being changed in terms of polarity, because the foregoing contributes to improvement of transferability in reverse side image formation. Even for obverse side image formation, it is preferable that reversal development is repeated on photoreceptor drum 10, and superposed color toner images each having the same polarity thus formed are collectively transferred onto recording sheet P without being changed in terms of polarity, because this contributes to improvement of transferability in obverse side image formation.

For the reason mentioned above, a two-sided image forming method wherein a first transfer means and a second transfer means are provided separately, and the first transfer means is operated to form a color toner image on the obverse side of a transfer material and then the second transfer means is operated to form a color toner image on the reverse side of the transfer material, is used preferably in color image formation.

Toner image receiving body 14*a* is an endless rubber belt having a thickness of 0.5–2.0 mm which is of a two-layer construction including a semi-conductive base having a resistance value of $10^8$–$10^{12}$ Ω·cm such as silicone rubber or urethane rubber and a fluorine-coated layer having a thickness of 5–50 μm provided on the rubber base as a toner-filming prevention layer. This layer is also preferable to be semi-conductive equally. It is also possible to use semi-conductive polyester or polystyrene, polyethylene or polyethylene terephthalate each having a thickness of 0.1–0.5 mm, in place of the rubber belt base.

Recording sheet P having on its both sides color toner images formed is neutralized by sheet separation AC neutralizing unit 14*h* which is for separation of a transfer material, then is separated from toner image receiving body 14*a,* and is conveyed to fixing unit 30 serving as a fixing means composed of two vertically-arranged fixing rollers each having therein a heating means (a heater), which will be described later. When the recording sheet P is subjected to heat and pressure between first fixing roller 310 located above and second fixing roller 320 located below, toner sticking to the obverse side and that sticking to the reverse side of the recording sheet P are fixed, and the recording sheet P two-sided image recording is conveyed by sheet-ejecting roller 18 to be ejected to a tray located outside an apparatus.

Toner remaining, after transferring, on the circumferential surface of the toner image receiving body 14*a* is removed by a blade which is provided on toner image receiving body cleaning unit 14*i* serving as a toner image receiving body cleaning means and can be brought into contact with toner image receiving body 14*a* or can be released from contact with toner image receiving body 14*a.*

Next, the state of toner images during a period from their formation on photoreceptor drum 10 to their entering a fixing unit after being transferred onto two sides or one side of recording sheet P will be explained as follows, referring to FIGS. 11(*a*)–12(*d*). In this case, the explanation will be for the occasion wherein the photoreceptor drum 10 which is an image forming body is charged negatively, and a latent image on the photoreceptor drum 10 is subjected to reversal development by means of toner having negative charges, thus a toner image having negative charges is formed on the photoreceptor drum 10.

Figure 11:
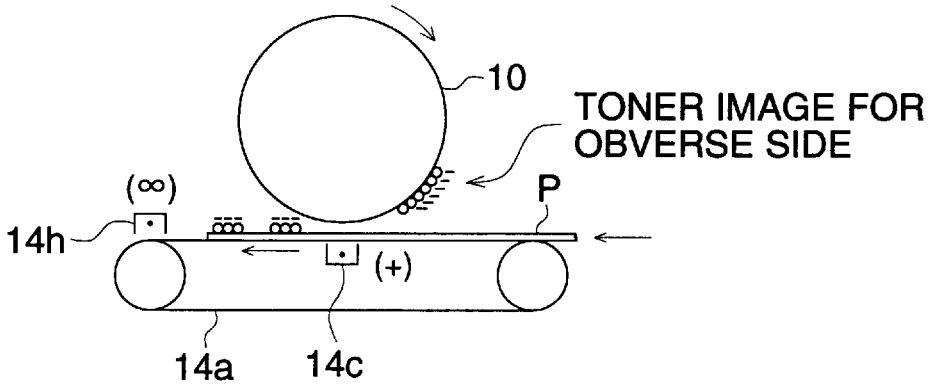
FIGS. 11(*a*) and 11(*b*) represent an illustration showing how toner images are formed on one side of a transfer material.
Figure 11:
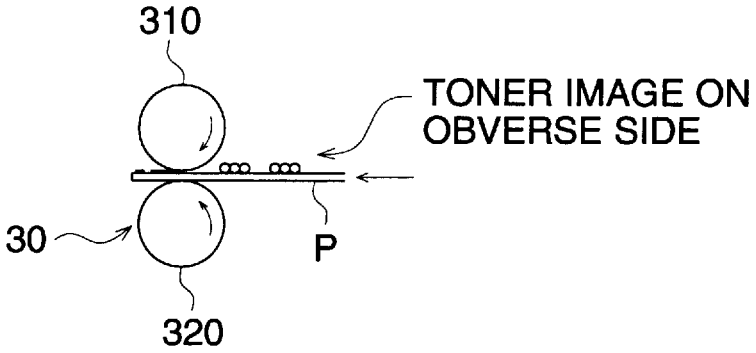

FIGS. 11(*a*) and 11(*b*) represent illustrations on which the recording sheet P enters fixing unit 30 while holding an toner image formed only on the obverse side of the recording sheet P through the first image forming step which directly transfers a toner image of an obverse side image formed on photoreceptor drum 10 onto the recording sheet P. The toner image of an obverse side image having negative polarity formed on the photoreceptor drum 10 is impressed with voltage having positive polarity, through recording sheet P and toner image receiving body 14*a* representing an intermediate transfer body located behind the recording sheet P, by the first transfer unit 14*c,* thus the toner image is transferred onto the recording sheet P (FIG. 11(*a*)). The recording sheet P holding on its upper side a toner image of an obverse side image having negative polarity is neutralized by sheet separation AC neutralizing unit 14*h,* then is separated from the toner image receiving body 14*a,* and enters fixing unit 30 having therein first fixing roller 310 and second fixing roller 320 (FIG. 11(*b*)).

Figure 12:
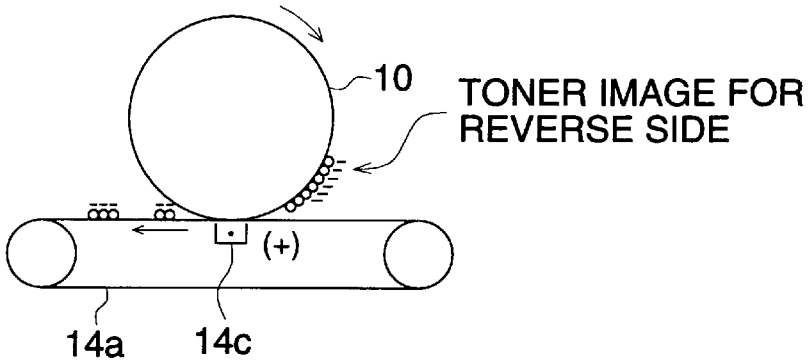
FIGS. 12(*a*)–12(*d*) represent an illustration showing how toner images are formed on both sides of a transfer material.
Figure 12:
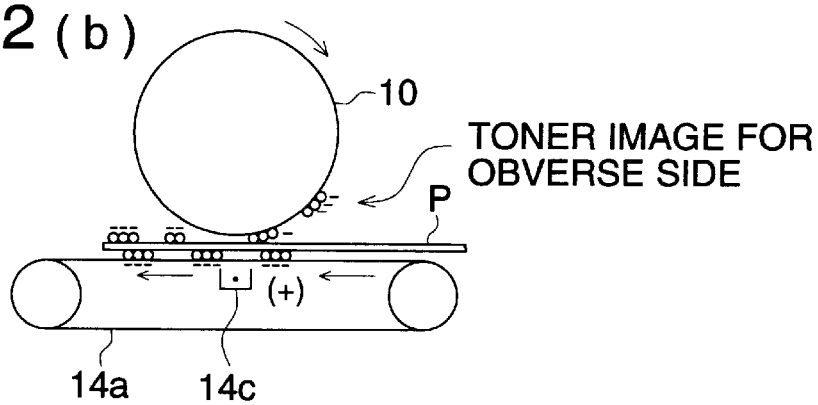
Figure 12:
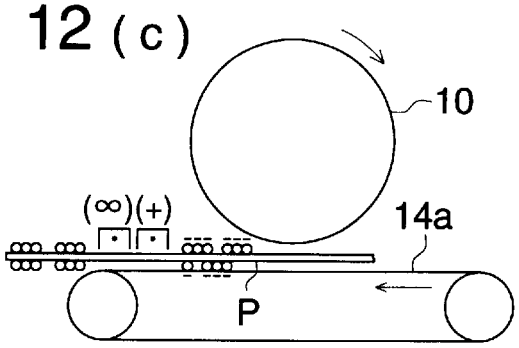
Figure 12:
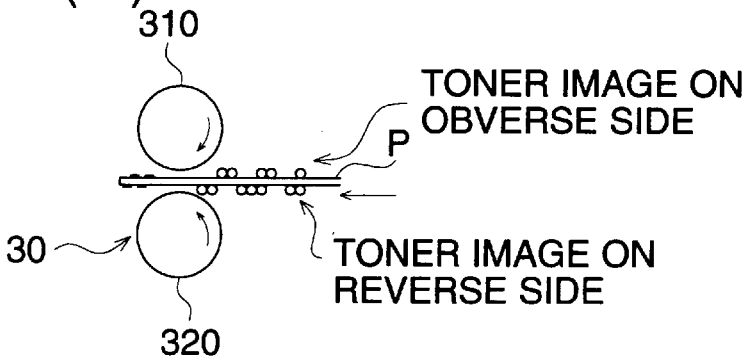

FIGS. 12(*a*)–12(*d*) represent illustrations in which toner images are stuck on both sides of recording sheet P through a first image forming process wherein a toner image of an obverse side image formed on photoreceptor drum 10 is directly transferred onto recording sheet P, and a second image forming process wherein a toner image of a reverse side image formed on photoreceptor drum 10 is transferred onto recording sheet P through an intermediate transfer body, and the recording sheet P having toner images sticking on its both sides enters fixing unit 30. The toner image of a reverse side image having negative polarity formed on photoreceptor drum 10 is impressed, from the back side of toner image receiving body 14*a,* with voltage having positive polarity by first transfer unit 14*c* to be transferred onto the toner image receiving body 14*a* (FIG. 12(*a*)). In succession, a toner image of an obverse side image having negative polarity is formed on the photoreceptor drum 10. The toner image of an obverse side image is impressed with voltage having positive polarity, through recording sheep P and toner image receiving body 14*a* holding the toner image of a reverse side image and located behind the recording sheet P, by the first transfer unit 14*c* to be transferred onto the upper side of the recording sheet P (FIG. 12(*b*)). Then, the toner image of a reverse side image sticking to the toner image receiving body 14*a* is impressed, from the upper side of the recording sheet P, with voltage having positive polarity by reverse side transfer unit 14*g* representing the second transfer means, to be transferred onto the under surface of the recording sheet P. In this case, voltage on the toner image of an obverse side image on the upper side of the recording sheet P is changed in terms of polarity from negative to positive when voltage with positive polarity is impressed from the point directly above by the reverse side transfer unit 14*g* (FIG. 12(*c*)). The recording sheet P holding on its upper side the toner image of an obverse side image having positive polarity and holding on its under side the toner image of an reverse side image having negative polarity is neutralized by sheet separation AC neutralizing unit 14*h,* and is separated from the toner image receiving body 14*a* to enter fixing unit 30 (FIG. 12(*d*)).

Figure 13:
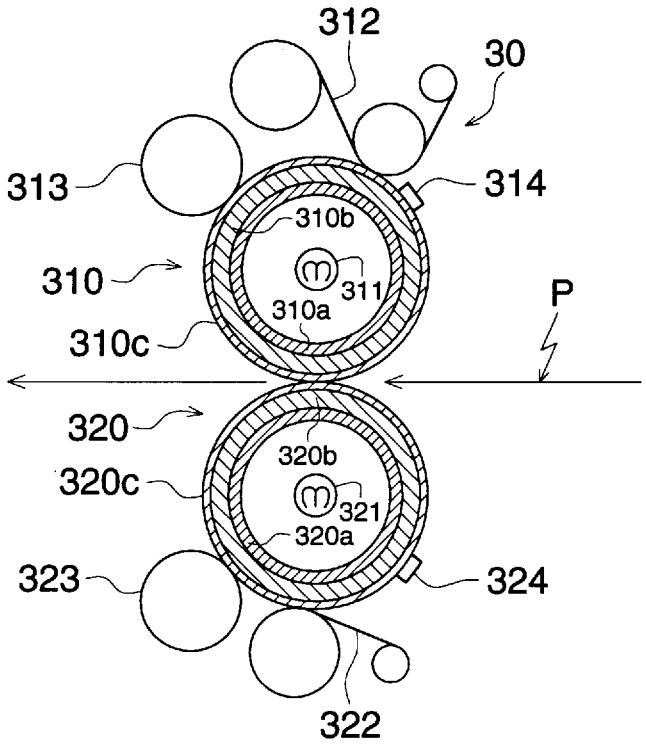
FIG. 13 is a sectional view showing the structure of a fixing unit (Example 1).
Figure 14:
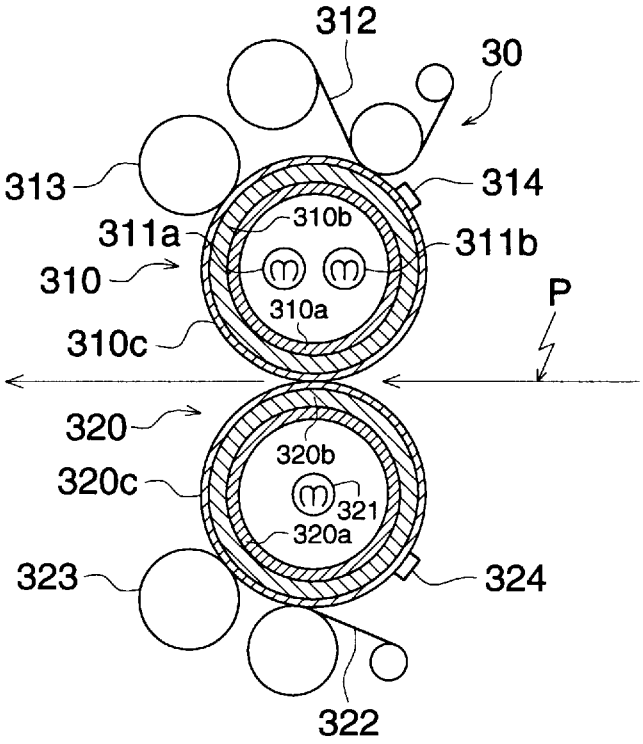
FIG. 14 is a sectional view showing the structure of a fixing unit (Example 2).

Next, a fixing unit related to the invention will be explained. FIG. 13 and FIG. 14 represent schematic sections showing respectively Example 1 and Example 2 of fixing unit 30. Members having the same function are shown with the same symbols, and explanation for them will be omitted.

First fixing roller 310 and second fixing roller 320 are provided, at their core portions inside thereof, respectively with first heater 311 representing a first heating means composed of a halogen lamp and second heater 321 representing a second heating means, and they are rotary fixing objects which are mostly the same in terms of structure. Roller portions of the first and second fixing rollers 310 and 320 are composed respectively of core barrels 310*a* and 320*a* each being made of a metal pipe, and the core barrels are provided thereon respectively with elastic body layers 310*b* and 320*b* each being composed of an elastic body such as silicone rubber having a thickness of 0.8–2.2 mm, and the elastic body layers are further provided thereon respectively with outermost layers 310*c* and 320*c* representing a PFA (perfluoroalkyl vinylether) layer having a thickness of 0.05–0.25 mm. Incidentally, as the outermost layers 310*c* and 320*c,* a heat resistant and highly releasing layer made of fluorine-containing resin or silicone resin such as PTFE (polytetrafluoroethylene) can be used in place in addition to PFA.

It is structured so that web cleaning units 312 and 322 each being made of nonwoven fabric, for example, may come into contact lightly with the surface of the first and second fixing rollers 310 and 320 respectively for removing toner and paper dust sticking to the surface of the fixing roller.

Further, for enhancing releasing properties of the first and second fixing rollers 310 and 320, there are provided oil coating rollers 313 and 323 each being sponge-shaped and oil-impregnated to coat release agent such as dimethylsilicone oil or denatured silicone oil on the roller surface.

There are further provided first temperature sensor 314 and second temperature sensor 324 representing respectively a first and second temperature detecting means each being composed of a thermistor, to be in contact with or to be in the vicinity of respectively the first and second fixing rollers, whereby surface temperature of the roller is detected, and energizing first heater 311 and second heater 321 is controlled as stated later based on the signals of the detection so that the temperature is kept within a prescribed range of temperature.

The first fixing roller 310 and the second fixing roller 320 are in pressure contact at a linear load of 0.8–1.8 kg/cm each other due to an urging member such as an unillustrated spring, and a length of a nip in this case is about 2–7 mm, though it varies depending on the linear load and hardness of the roller. The first fixing roller 310 and the second fixing roller 320 are driven by the same driving source so that they do not slip on the nip portion between them, thus they rotate at the same linear speed (160 mm/sec in the present example) to perform two-sided fixing at the nip portion.

In the present image forming apparatus wherein toner images on both sides are collectively transferred, when an electric field forming means such as an unillustrated corona charging unit or a roller charging unit that is conductive and sponge-shaped to be capable of being driven for rotation is provided for forming an electric field between each of the first and second fixing rollers 310 and 320 and recording sheet P sandwiched between the fixing rollers to be conveyed in fixing unit 30 representing a fixing means, or when there is provided an electric field forming means to impress bias voltage of +200 V on the first fixing roller 310 and −200 V on the second fixing roller 320 by structuring outermost layers 310*c* and 320*c* respectively of the first and second fixing rollers 310 and 320 and elastic body layers 310*b* and 320*b* with conductive materials containing carbon black or titanium oxide to be conductive, and by connecting each of core barrels 310*a* and 320*a* with an unillustrated bias power supply, the first fixing roller 310 can be charged to be in the same polarity as that of toner charge of the upper toner image and the second fixing roller 320 can be charged to be in the same polarity as that of toner charge of the lower toner image, thus electric repulsive force between toner and a roller is enhanced, and electric offset of static electricity can be completely dissolved.

A difference between fixing unit 30*a* in FIG. 14 and fixing unit 30 in FIG. 13 is that plural (two) heating means of first a heater 311*a* and first b heater 311*b* are provided inside first fixing roller 310 in fixing unit 30*a*.

In the above-mentioned image forming apparatus having therein a first copy mode that forms a toner image and fixes it only on one side (obverse side) of a transfer material and a second copy mode that forms toner images and fixes them collectively on both sides of a transfer material, when a mode is designated by a designating means, image forming and image fixing are excellently controlled, and excellent image recording can be done. This control method will be explained as follows.

Figure 15:
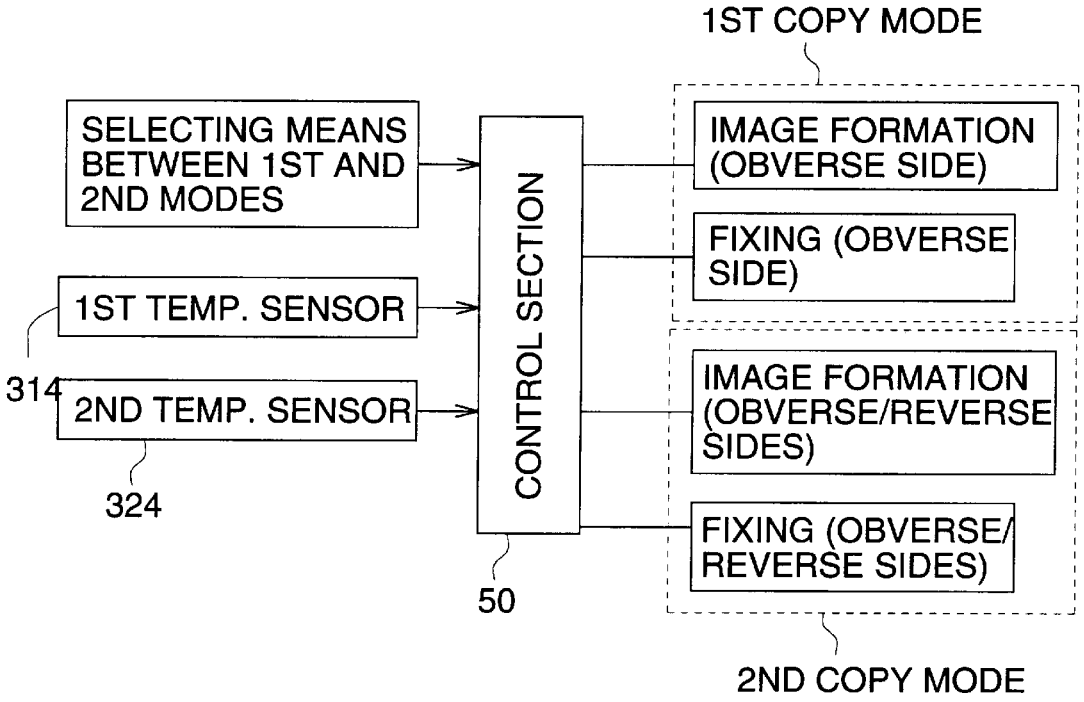
FIG. 15 is a block diagram showing the control of switching between a one-sided copy mode and a two-sided copy mode.

FIG. 15 is a block diagram showing the control in the invention. On the operation panel of an image forming apparatus main body, there is provided a mode selection button which makes a user to select the first copy mode or the second copy mode. In addition to these, there is provided a third copy mode which is for automatic selection, and when reading an image of an original with an unillustrated original reading unit, the third copy mode detects whether an image exists on the reverse side of the original or not and automatically selects the first copy mode if no reverse side image is detected, while the third copy mode automatically selects the second copy mode if the reverse side image is detected, for image forming and image fixing.

When the first copy mode is selected, control section 50 calls image information on the obverse side from a memory or from an original reading unit, then, forms a toner image of the obverse side image on photoreceptor drum 10, and transfers the toner image of the obverse side on the photoreceptor drum 10 onto recording sheet P that is fed in synchronization by first transfer unit 14*c* (first image forming process). The above-mentioned unillustrated electric field forming means is operated in the fixing unit 30 so that negative electric field may be formed for the first fixing roller 310, for recording sheet P which holds on its upper surface the toner image and is conveyed to the fixing unit 30. On the other hand, the above-mentioned unillustrated electric field forming means is not operated for the second fixing roller 320. The control mentioned above makes the obverse side image to be fixed, and the recording sheet P which has been fixed is conveyed by sheet ejecting roller 18 to be delivered onto a tray located on the outside of an apparatus.

When the second copy mode is selected, control section 50 first calls image information on the reverse side from a memory or from an original reading unit, then, forms a toner image of the reverse side image on photoreceptor drum 10, and transfers the toner image of the reverse side on the photoreceptor drum 10 onto toner image receiving body 14*a* representing an intermediate transfer body with the first transfer unit 14*c*. Then, the control section 50 forms a toner image of the obverse side image on the photoreceptor drum 10 which has been subjected to transfer and cleaning. Then, the toner image of the obverse side image is transferred onto the upper side (obverse side) of recording sheet P that is fed in synchronization by first transfer unit 14*c* (first image forming process), and the toner image of the reverse side image on the toner image receiving body 14*a* is transferred onto the lower side of the recording sheet P by reverse side transfer unit 14*g* (second image forming process). For the recording sheet P holding on its both sides the toner images which has been conveyed to fixing unit 30, unillustrated electric field forming means (corona charging unit, roller charging unit, and bias power supply) are operated in the fixing unit 30 so that a positive electric field may be formed for the first fixing roller 310. On the other hand, unillustrated electric field forming means (corona charging unit, roller charging unit, and bias power supply) are operated so that a negative electric field may be formed for the second fixing roller 320. Incidentally, for the second fixing roller 320, a roller may be controlled so that it is grounded as a conductive roller. Due to such control, images on both sides are fixed, and the recording sheet P which has been fixed is conveyed by sheet ejecting roller 18 to be delivered onto a tray located on the outside of an apparatus.

EXAMPLE 1

In the image forming apparatus attaining the third object having the first structure, the maximum power consumption of the first heater 311 that is a first heating means is set to be greater than that of the second heater 321 that is a second heating means in fixing unit 30 of the image forming apparatus mentioned above.

In the case of the first copy mode (one-sided), only the first fixing roller 310 has to be heated, because a toner image is formed only on the obverse side of recording sheet P. To the contrary, it is necessary to heat both the first fixing roller 310 and the second fixing roller 320 in the case of the second copy mode (two-sided), because both sides of recording sheet P need to be fixed. In the second copy mode, however, conveyance of the recording sheet P to be fixed to the fixing unit 30 is an intermittent conveyance having the interval of a relatively long suspension time, because a toner image formed on photoreceptor drum 10 arrives at the fixing unit 30*a* through the process that the toner image is once transferred onto toner image receiving body 14*a* representing an intermediate transfer body, and then is transferred onto the recording sheet P, thus, a quantity of heat consumed by the first fixing roller 310 and the second fixing roller 320 can be compensated within the suspension time. Namely, a quantity of power to be supplied to the first heater 311 and the second heater 321 in the second copy mode can be less than that to be supplied to the first heater 311 in the first copy mode, whereby it is possible to achieve excellent fixing with less power consumption in either of the first copy mode and the second copy mode, by making the maximum power consumption for the first heater 311 to be greater than that for the second heater 321.

When the maximum power consumption for the first heater 311 is smaller than that for the second heater 321. on the contrary, a quantity of heat consumed by the first roller 310 can not be compensated within the suspension time, or unnecessary power is supplied excessively to the second heater 321, in the case of continuous copying in the first copy mode.

Incidentally, when the second mode (two-sided copy mode) is selected in the first structure, control section 50 makes second temperature sensor 324 to detect the surface temperature of the second fixing roller facing the reverse side of recording sheet P. When the surface temperature is lower than the temperature set, the control section 50 controls so that at least the second fixing roller 320 is heated simultaneously by the second heater 321 located inside the second fixing roller 320 while the first fixing roller 310 and the second fixing roller 320 are in pressure contact each other to be rotated, before the recording sheet P enters the fixing unit 30, and thereby the surface temperature of the second fixing roller becomes to be appropriate for the temperature set. Due to such constitution, it is possible to save a quantity of power to be supplied to the fixing unit 30 and to switch quickly to the state of ready for fixing in the mode change.

EXAMPLE 2

In the image forming apparatus attaining the third object having the second structure, power to be supplied to each of the first heater 311 representing the first heating means and the second heater 321 representing the second heating means is made to be variable, and $P_{K1}$, $P_{K2}$, $P_{R1}$ and $P_{R2}$ are controlled in control section 50 so that the relation of $P_{K1} \geqq P_{R1} \geqq P_{R2} > P_{K2}$ may be satisfied when assuming that $P_{K1}$ represents power to be supplied to the first heater 311 in the first copy mode (one-sided), $P_{K2}$ represents power to be supplied to the second heater 321 in the first copy mode, $P_{R1}$ represents power to be supplied to the first heater 311 in the second copy mode (two-sided), and $P_{R2}$ represents power to be supplied to the second heater 321 in the second copy mode.

Figure 16:
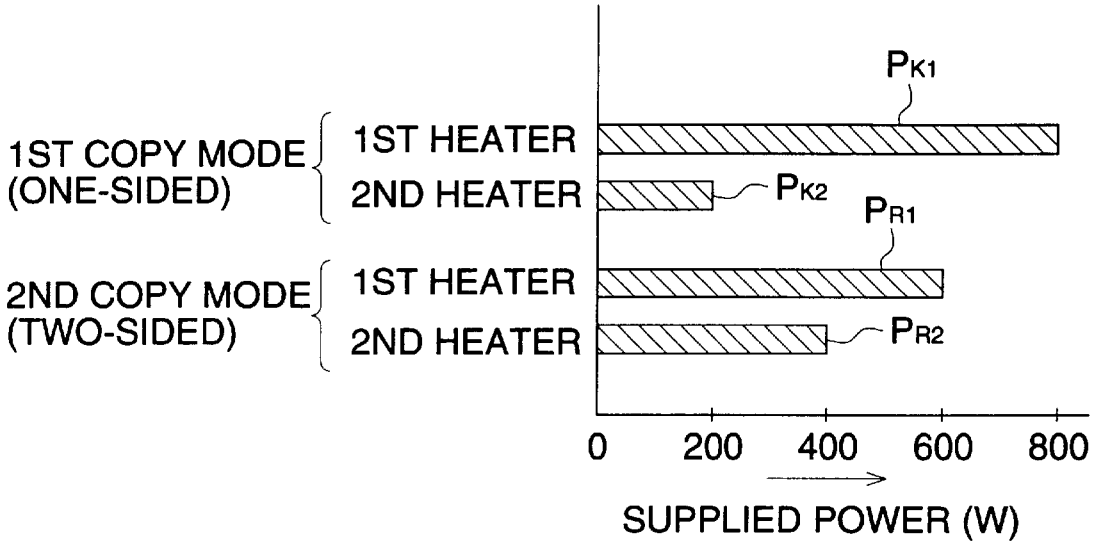
FIG. 16 is a bar graph showing an example of power consumption of each heater.

An example of the relation mentioned above is shown in FIG. 16. By controlling in the aforesaid manner, unnecessary power is not supplied excessively and it is possible to save a quantify of power to be supplied to fixing unit 30 both in the first copy mode and the second copy mode and to realize satisfactory fixing.

Figure 17:
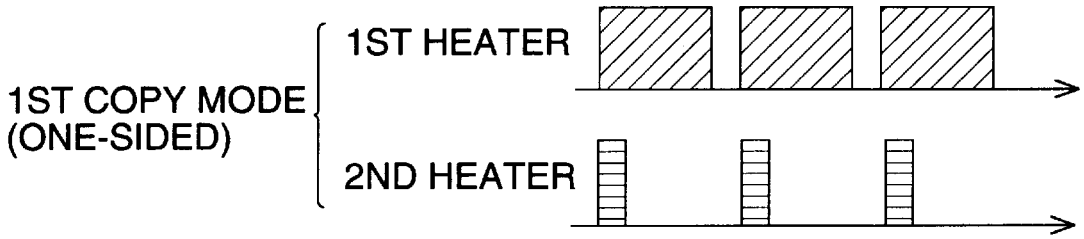
FIGS. 17(*a*)–17(*d*) represent a diagram illustrating an example of power control.
Figure 17:
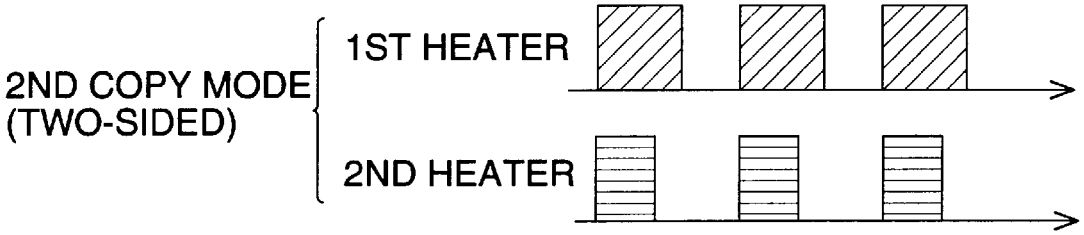
Figure 17:
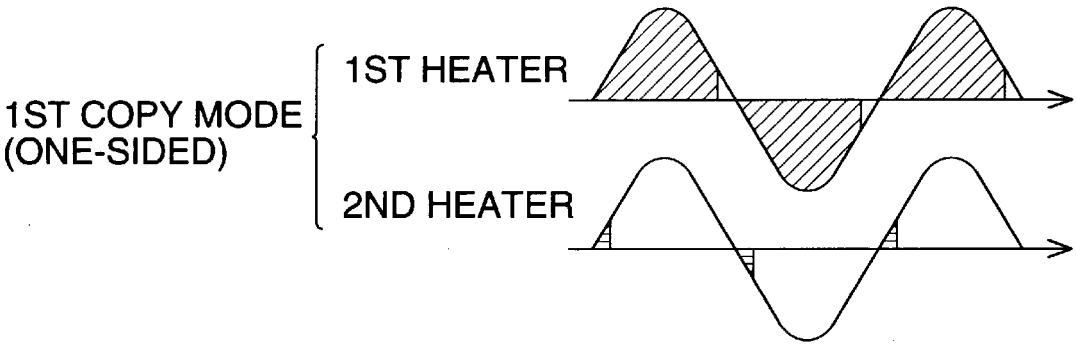
Figure 17:
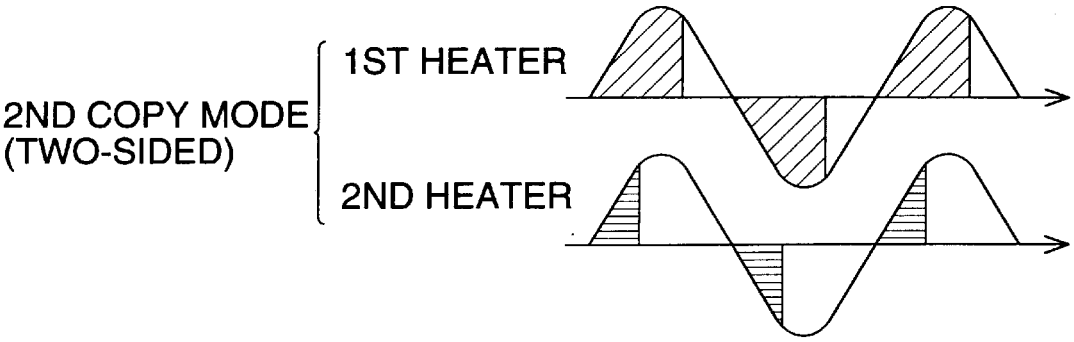

Incidentally, with regard to the means to control power to be supplied depending upon copy modes for one-sided copying and two-sided copying in the second structure, when the power source for supplying power to the first heater 311 and the second heater 321 is a DC power system, it is preferable that output is controlled through pulse width modulation (PWM) as shown in FIGS. 17(*a*) and 17(*b*), while, when the power source is an AC power system, it is preferable that an effective voltage value or an effective current value is controlled through phase control as shown in FIGS. 17(*c*) and 17(*d*) (hatched portions in the drawings represent energized portions).

Or, power to be supplied can also be controlled by making at least one of the first heater 311 and the second heater 321 to be a combination of two heaters, and by switching the combination of output and non-output of the heaters such as OFF for both heaters, ON for one heater and OFF for the other heater, or ON for both heaters.

EXAMPLE 3

In the image forming apparatus attaining the third object having the third structure, heat capacity of the first fixing roller 310 may be made to be greater than that of the second fixing roller 320 in fixing unit 30 of the image forming apparatus, for example, a thickness of elastic body layer 310*b* representing an intermediate layer of the first fixing roller 310 can be made to be greater than that of elastic body layer 320*b* representing an intermediate layer of the second fixing roller 320. Or, a thickness of core barrel 310*a* of the first fixing roller can be made to be greater than that of core barrel 320*a* of the second fixing roller 320.

Due to the foregoing, even in the case of continuous copying under the first copy mode (one-sided), temperature drop of the first fixing roller is slight, resulting in satisfactory fixing, and when the first copy mode (one-sided) is changed to the second copy mode (two-sided), heating in second fixing roller 320 can make the surface temperature of the second fixing roller 320 to reach, in a short period of time, a temperature range wherein fixing is possible, through small heat capacity and excellent heat conduction.

EXAMPLE 4

In the image forming apparatus attaining the third object having the fourth structure, the first fixing roller 310 and second fixing roller 320 have respectively elastic body layers 310*b* and 320*b* in the fixing unit 30 of the image forming apparatus mentioned above, and the condition of $(d_1/\kappa_1)>(d_2/\kappa_2)$ is satisfied when $\kappa_1$ represents thermal conductivity of the elastic body layer 310*b* of the first fixing roller 310, $d_1$ represents a layer thickness, $\kappa_2$ represents thermal conductivity of the elastic body layer 320*b* of the second fixing roller 320, and $d_2$ represents a layer thickness. In this case, a unit symbol of $\kappa_1$ and $\kappa_2$ is (cal/cm·°C.) and its value is about 0.00055–0.00075 (0.00067 for silicone rubber), while a value of $d_1$ and $d_2$ is normally 1–5 mm. Since the time required for a unit heat quantity to pass through each of the elastic body layers 310*b* and 320*b* through heat conduction is proportional to the product of an inverse number of thermal conductivity of the elastic body layer and its layer thickness, the above-mentioned condition makes the heat conduction from the first fixing roller 310 to the second fixing roller 320 to be great, and thereby heating in second fixing roller 320 can make the surface temperature of the second fixing roller 320 to reach, in a short period of time, a temperature range wherein fixing is possible, when the first copy mode (one-sided) is changed to the second copy mode (two-sided).

EXAMPLE 5

In the image forming apparatus attaining the third object having the fifth structure, there is provided fixing unit 30*a* shown in FIG. 14 in which the sum of the maximum power consumption of the first A heater 311*a* and that of the second heater 321 and the sum of the maximum power consumption of the first A heater 311*a* and that of the first B heater 311*b* are respectively established to be equal to or lower than the maximum power consumption allowed for the fixing unit 30, and simultaneous energizing for the second heater 321 and for the first B heater 311*b* is prohibited. Incidentally, this image forming apparatus is provided, in addition to the first copy mode (one-sided copy mode for copying only on the obverse side) and the second copy mode (two-sided copy mode), with a reverse side copy mode wherein a toner image is formed only on the reverse side of recording sheet P.

For example, when an allowable power consumption of the fixing unit 30*a* is 1000 W in FIG. 14, power consumption of the first A heater 311*a* is set to 600 W, power consumption of the first B heater 311*b* is set to 400 W, and that of the second heater 321 is set to 400 W. When power consumption of each heater is set as stated above, and when the first A heater 311*a* and first B heater 311*b* are energized in the case of the first copy mode (one-sided copy mode for copying only on the obverse side) and the first A heater 311*a* and the second heater 321 are energized in the case of the second copy mode (two-sided copy mode), the power consumption does not exceed the allowable power consumption (1000 W) in the both cases mentioned above. Though recording sheets P pass through the fixing unit 30*a* continually at short intervals in the first copy mode, temperature of the first fixing roller 310 does not fall and no trouble takes place for fixing, because maximum power is supplied to the first fixing roller 310.

The structure mentioned above makes it possible to attain a one-sided copy mode for forming an image only on the reverse side of recording sheet P. In the one-sided copy mode for copying on the reverse side, recording sheet P to be fixed is subjected to intermittent conveyance at relatively long intervals, because the recording sheet P reaches the fixing unit 30*a* after passing through the process wherein a toner image formed on photoreceptor drum 10 is transferred once onto toner image receiving body 14*a* representing an intermediate transfer body and then is transferred onto the recording sheet P. Therefore, there is enough time for the lowered temperature to be restored to the prescribed temperature, and whereby, power consumption for the second heater 321 of the second fixing roller 320 can be small.

Incidentally, in the fifth structure mentioned above, in the case of the second copy mode for forming toner images on both sides of recording sheet P or when forming a toner image only on the reverse side on a one-sided copy basis, the first A heater 311*a* and the second heater 321 are energized, while in the case of the first copy mode for forming a toner image only on the obverse side of recording sheet P, the first A heater 311*a* and the first B heater 311*b* are energized.

The fixing unit 30*a* is provided with first temperature sensor 314 which detects the surface temperature of the first fixing roller 311 and the second temperature sensor 324 which detects the surface temperature of the second fixing roller 321, and control section 50 controls energizing for the first A heater 311*a* and the first B heater 311*b* independently or by interlocking them based on temperature information outputted by the first temperature sensor 314 through its detection, and controls energizing for the second heater 321 based on temperature information outputted by the second temperature sensor 324 through its detection, so that the surface temperature of the first fixing roller 310 and that of the second fixing roller 320 may be maintained at an appropriate temperature.

Two concrete examples of the aforesaid control will be explained.

First Example

The first A heater 311*a* and the first B heater 311*b* are controlled independently.

In the case of the first copy mode (one-sided copy mode for copying only on the obverse side): the first A heater 311*a* and the first B heater 311*b* are used to conduct the following control.

(1) The first A heater 311*a* is turned on when the temperature detected by the first temperature sensor 314 comes to 170° C. or less.

(2) The first A heater 311*a* is turned off when the temperature detected by the first temperature sensor 314 exceeds 180° C.

(3) The first B heater 311*b* is turned on when the temperature detected by the first temperature sensor 314 comes to 165° C. or less.

(4) The first B heater 311*b* is turned off when the temperature detected by the first temperature sensor 314 exceeds 175° C.

In the case of the second copy mode (two-sided copy mode): the first A heater 311*a* and the second heater 321 are used to conduct the following control.

(1) The first A heater 311*a* is turned on when the temperature detected by the first temperature sensor 314 comes to 170° C. or less.

(2) The first A heater 311*a* is turned off when the temperature detected by the first temperature sensor 314 exceeds 175° C.

(3) The second heater 321 is turned on when the temperature detected by the second temperature sensor 324 comes to 170° C. or less.

(4) The second heater 321 is turned off when the temperature detected by the second temperature sensor 324 exceeds 175° C.

In the case of the reverse side copy mode (one-sided copy mode for copying only on the reverse side): the first A heater 311*a* and the second heater 321 are used to conduct the following control.

(1) The first A heater 311*a* is turned on when the temperature detected by the first temperature sensor 314 comes to 150° C. or less.

(2) The first A heater 311*a* is turned off when the temperature detected by the first temperature sensor 314 exceeds 160° C.

(3) The second heater 321 is turned on when the temperature detected by the second temperature sensor 324 comes to 170° C. or less.

(4) The second heater 321 is turned off when the temperature detected by the second temperature sensor 324 exceeds 180° C.

Though it is not necessary to control the temperature of the first fixing roller 310 in the reverse side copy mode, it is so arranged in the present example as to energize not only the second heater 321 but also the first A heater 311*a,* so that the temperature of the first fixing roller 310 may be changed quickly to the usable temperature when the first copy mode or the second copy mode is selected after the reverse side copy mode. Despite such arrangement, waste of power to be consumed is slight because a probability of selecting the reverse side copy mode is extremely low.

Second Example

The first A heater 311*a* and the first B heater 311*b* are controlled on an interlocked basis.

In the case of the first copy mode (one-sided copy mode for copying only on the obverse side): the first A heater 311*a* and the first B heater 311*b* are used to conduct the following control.

(1) The first A heater 311*a* and the first B heater 311*b* are turned on when the temperature detected by the first temperature sensor 314 comes to 170° C. or less.

(2) The first A heater 311*a* and the first B heater 311*b* are turned off when the temperature detected by the first temperature sensor 314 exceeds 180° C.

In the case of the second copy mode (two-sided copy): the first A heater 311*a* and the second heater 321 are used, and they are controlled, in the same manner as in the first example, by turning on or turning off the first A heater 311*a* and the second heater 321.

In the case of the reverse side copy mode (one-sided copy mode for copying only on the reverse side): the control that is the same as in the reverse side copy in the first example is conducted.

Incidentally, it is preferable that fixing unit 30*a* in this case is controlled in the following way.

In the course of warming-up, the first A heater 311*a* and the second heater 321 are continuously energized.

In the state of idling (state of standby for copying), only the first A heater 311*a* or only the first B heater 311*b* is turned on or turned off.

During the period when a toner image on toner image receiving body 14*a* is being transferred (period when a reverse side image is being formed) after the first copy mode is changed to the second copy mode or to the reverse side copy mode, fixing unit 30*a,* which does not need to be rotated and operated for itself, is rotated and operated (preliminary rotation) even in this period so that heat may be supplied from the first fixing roller 310 to the second fixing roller 320 for shortening the time for the temperature of the second fixing roller 320 to be raised to its usable temperature and for uniforming the surface temperature.

A heating range of the first A heater 311*a* and that of the first B heater 311*b* are made to be different in the direction of their axes, so that temperature rise on the edges (portions where recording sheet P does not pass through) may be prevented for different widths of recording sheet P (e.g., A system paper size and B system paper size).

The maximum power consumption of the first A heater 311*a* is made to be greater than that of the second heater 321 (since heating of the second fixing roller 320 can be intermittent as stated before, power consumption of the second heater 321 can be made small, and this makes total power consumption small).

When allowable power for a fixing unit is 1000 W, for example, it has been common in the past that each of first fixing roller 310 and second fixing roller 320 employs one heater which is a heating means, and power consumption of first heater 311 is set to 600 W and that of second heater 321 is set to 400 W. In the aforesaid arrangement, the first heater 311 alone has been used (maximum power consumption in this case is 600 W) in the first copy mode (one-sided copy for copying only on the obverse side), while the first heater 311 and the second heater 321 have been used (maximum power consumption in this case is 1000 W) in the second copy mode (two-sided copy) and the one-sided copy for copying on the reverse side.

In the case of the example mentioned above, there sometimes occurred an occasion that the fixing roller temperature is lowered resulting in insufficient fixing for continuous copying when an ambient temperature is low or when a thick sheet is used for recording sheet P, because power consumption is as small as 600 W in the first copy mode. To the contrary, in the apparatus of the invention, sufficient power to be consumed is supplied to each heater within the maximum power consumption for any copy mode, and whereby the temperature of each fixing roller can be kept within an appropriate range.

EXAMPLE 6

In the image forming apparatus attaining the third object having the sixth structure, there is provided fixing unit 30 in which the maximum power consumption of the first heater 311 and that of the second heater 321 are respectively set not to be more than the maximum power consumption allowed for the fixing unit 30, and simultaneous energizing for both the first heating means and the second heating means is prohibited. Incidentally, this image forming apparatus also has the reverse side copy mode, in addition to the first copy mode (one-sided copy mode for copying only on the obverse side) and the second copy mode (two-sided copy mode).

In an instance of the present example, when the allowable power for a fixing unit is 1000 W, for example, the first fixing roller 310 has its own heating means of first heater 311 whose power consumption is 1000 W and the second fixing roller 320 has its own heating means of second heater 321 whose power consumption is also 1000 W. In the aforesaid arrangement, the first heater 311 alone is used (maximum power consumption in this case is 1000 W) in the first copy mode (one-sided copy for copying only on the obverse side), while the first heater 311 and the second heater 321 are used alternately (maximum power consumption in this case is 1000 W) in the second copy mode (two-sided copy) and the one-sided copy for copying on the reverse side.

In this case, though recording sheets P are conveyed to fixing unit 30 continually in the first copy mode, the surface temperature of the first fixing roller 311 is not lowered because the power consumption of the first heater 311 is 1000 W. In the case of the second copy mode or in the one-sided copy mode for the reverse side, recording sheets P are conveyed intermittently to fixing unit 30 at relatively long intervals, because of the process wherein a toner image on photoreceptor drum 10 is transferred temporarily onto toner image receiving body 14*a* and then is transferred onto recording sheet P. Therefore, even when the first heater 311 and the second heater 321 are turned on alternately, sufficient quantity of heat can be obtained.

With regard to the control for energizing in this case, the first heater 311 only is used and it is turned on or off depending on the temperature detected by the first temperature sensor 314, in the case of the first copy mode (one-sided copy).

The first heater 311 and the second heater 321 are used, and they are turned on or off alternately at prescribed time internals in the manner that both of them are not turned on simultaneously, in the case of the second copy mode (two-sided copy).

Depending on the temperatures detected by the first temperature sensor 314 and the second temperature sensor 324, it is sometimes necessary for both the first heater 311 and second heater 321 to be turned on simultaneously. In this case, either a heater of the fixing roller deviated more greatly from the established temperature is given priority to be turned on or the first heater 311 is turned on taking precedence over the second heater, regardless of the established temperature, and the time for ON of the heater of the fixing roller deviated more greatly from the established temperature is set to be long.

The first heater 311 and the second heater 321 are used, and they are turned on or off alternately in the manner that both of them are not turned on simultaneously, in the case of the one-sided copy mode for the reverse side.

Depending on the temperatures detected by the first temperature sensor 314 and the second temperature sensor 324, it is sometimes necessary for both the first heater 311 and second heater 321 to be turned on simultaneously. In this case, the second heater 321 of the second fixing roller is turned on taking precedence over the first heater 311 regardless of the established time.

In this case, it is preferable to do the following.

The first heater 311 is energized continuously during a period of warming-up.

During a period of idling, the first heater 311 is turned on or off taking precedence over the second heater 321.

During the period when a toner image on toner image receiving body 14*a* is being transferred (period when a reverse side image is being formed) after the first copy mode is changed to the second copy mode or to the reverse side copy mode, fixing unit 30, which does not need to be rotated and operated for itself, is rotated and operated even in this period so that heat may be supplied from the first fixing roller 310 to the second fixing roller 320 for shortening the time for the temperature of the second fixing roller 320 to be changed to its usable temperature (time required for temperature rise) and for uniforming the surface temperature.

The maximum power consumption of the first heater 311 is made to be greater than that of the second heater 321 (since heating of the second fixing roller 320 can be intermittent as stated before, power consumption of the second heater 321 can be made small).

By controlling the power supply as stated above, sufficient fixing can be conducted with power consumption that is within the maximum power consumption allowed for any copy mode.

Though there have been explained examples of the image forming apparatus wherein power consumption is controlled to the utmost and well-fixed images can be obtained stably, the invention can also offer the same effect to the image forming apparatus provided with a fixing unit employing a fixing belt, in addition to the that equipped with the fixing unit employing the fixing roller.

Owing to the first structure, it is possible to save a quantity of power to be supplied to a heating means of the fixing means and thereby to obtain well-fixed images effectively with less power consumption, in the image forming apparatus wherein toner images are formed on both sides of a transfer material and are fixed collectively.

Owing to the second structure, it is possible to obtain well-fixed images with less power consumption in the aforesaid image forming apparatus by making the distribution of a quantity of power to be supplied to each heating means to be appropriate.

Owing to the third structure, it is possible to same a quantity of power to be supplied to heating means and to obtain well-fixed images with less power consumption in the aforesaid image forming apparatus by making the heat capacity of the fixing roller of the second fixing means to be smaller than that of the fixing roller of the first fixing means.

Owing to the fourth structure, even when a transfer material having toner images on its both sides is collectively fixed, excellent fixing can be conducted with less power consumption in the aforesaid image forming apparatus, and heat conduction from the first fixing roller 310 to the second fixing roller 320 is great when the first copy mode (one-sided) is changed to the second copy mode (two-sided), thus, it is possible for the surface temperature of the second fixing roller 320 to reach a range which makes the fixing possible in a short period of time.

Owing to the fifth structure, it is possible to supply effectively sufficient power to heating means of the first and second fixing rollers within the allowable maximum power consumption in the aforesaid image forming apparatus, and whereby to conduct excellent fixing with less power consumption, by providing a plurality of heating means to the first fixing roller of the fixing unit.

Owing to the sixth structure, it is possible to supply effectively sufficient power to heating means of the first and second fixing rollers within the allowable maximum power consumption and whereby to obtain well-fixed images with less power consumption in the aforesaid image forming apparatus.

EXAMPLE 7

Figure 18:
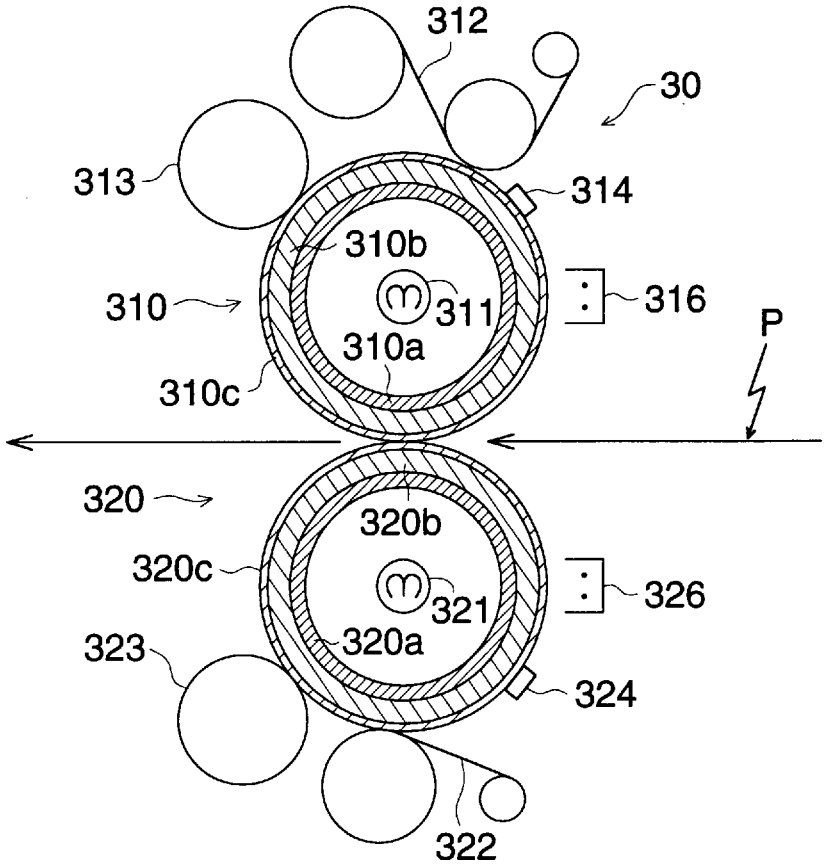
FIG. 18 is a sectional view showing the structure of a fixing unit (Example 3).

In the image forming apparatus attaining the third object having the seventh structure of the invention, an electric field forming means that forms an electric field between each of the upper and lower fixing rollers 310 and 320 representing a fixing means and recording sheet P is provided in fixing unit 30 representing a fixing means, and FIG. 18 is a sectional view showing the structure of the third example. In the drawing, the numeral 316 represents a corona charging unit provided as an electric field forming means, and it is located so that it faces the upper fixing roller 310, and it is a corona charging unit provided as a charging means that gives to the surface of an insulating roller the positive charges which are the same, in terms of polarity, as toner charges of the toner image on the upper side of recording sheet P. The numeral 326 is a corona charging unit provided so that it faces the lower fixing roller 320, and it gives to the surface of an insulating roller the negative charges which are the same, in terms of polarity, as toner charges of the toner image on the lower side of the recording sheet P. By enhancing electric repulsing force between toner and a roller by using a corona charging unit as an electric field forming means as stated above, by charging the upper fixing roller 310 with the polarity identical to that of toner charges of the upper toner image, and by charging the lower fixing roller 320 with the polarity identical to that of toner charges of the lower toner image, it was possible to dissolve electric offset of static electricity completely in an image forming apparatus wherein two-sided toner images are fixed collectively.

Figure 19:
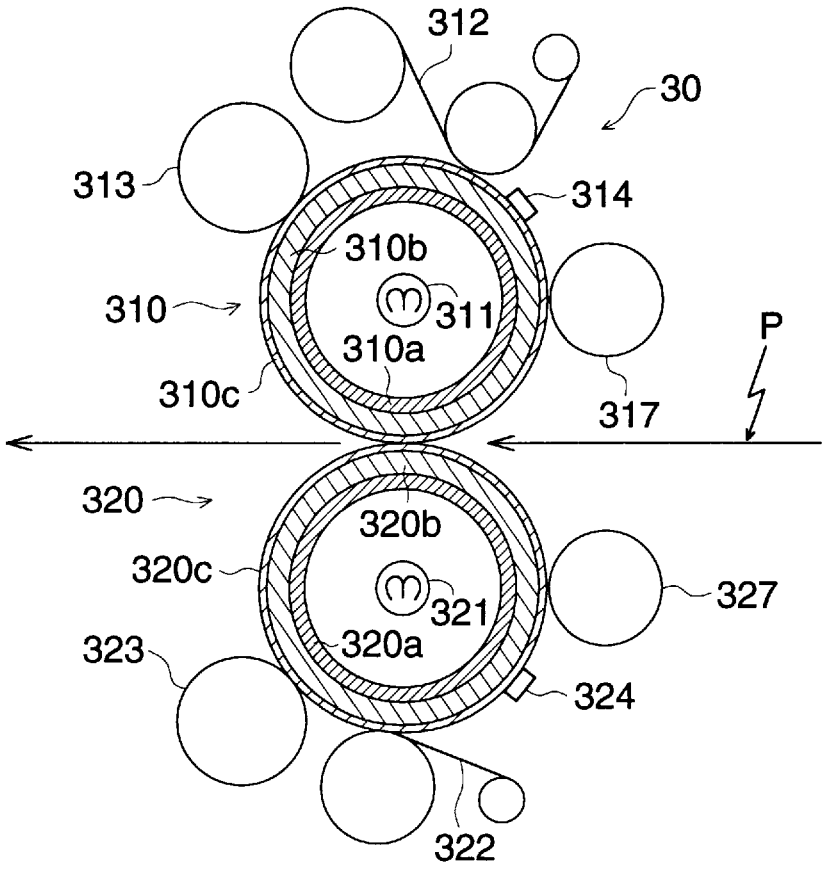
FIG. 19 is a sectional view showing the structure of a fixing unit (Example 4).

FIG. 19 is a sectional view showing the structure of the fourth example. In the drawing, the numerals 317 and 327 represent a conductive and sponge-shaped roller charging unit capable of being driven for rotation. The roller charging unit 317 impressed with +200 V voltage is brought into contact with the insulating roller surface of the upper fixing roller 310 for rotation, while the roller charging unit 327 impressed with −200 V voltage is brought into contact with the insulating roller surface of the lower fixing roller 320 for rotation, so that the roller surface may have the same polarity as that of toner, and occurrence of offset of static electricity in the course of fixing is dissolved, in the same way as in the first example.

Figure 20:
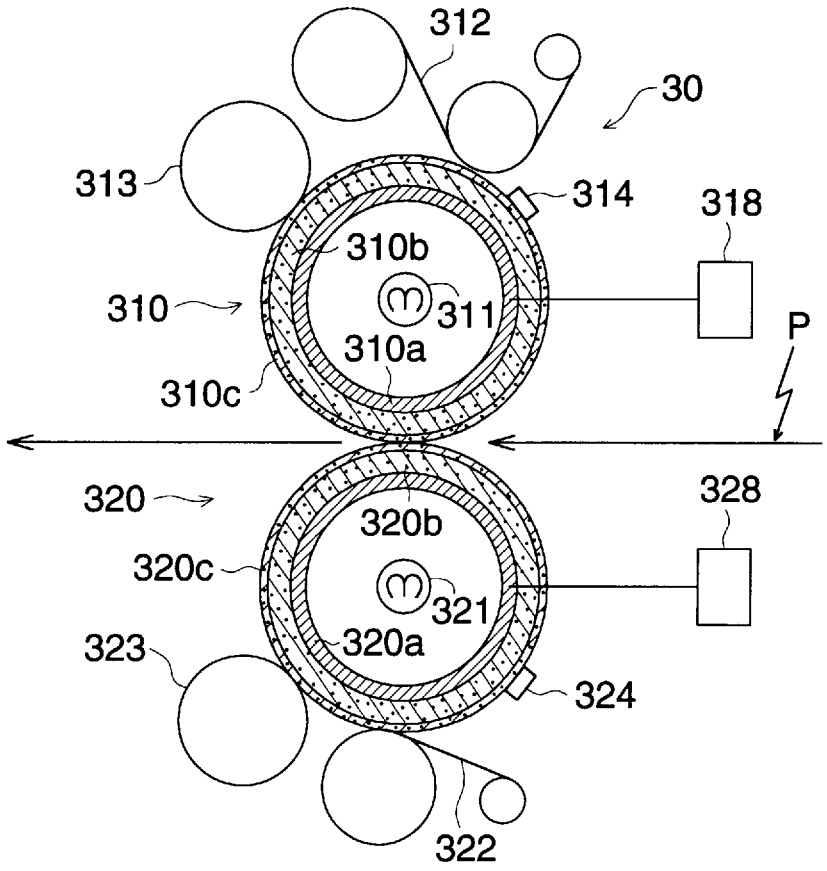
FIG. 20 is a sectional view showing the structure of a fixing unit (Example 5).

FIG. 20 shows the fifth example. In this example, the upper fixing roller and the lower fixing roller 310 and 320 are made to be a roller structured with conductive material which has been given conductivity, by contain carbon black or titanium oxide in outermost layers 310*c* and 320*c* as well as in intermediate layers 310*b* and 320*b*, and bias voltage of +200 V is impressed on the upper fixing roller 310 and bias voltage of −200 V is impressed on the lower fixing roller 32 by connecting bias power sources 318 and 328 with core metals of the rollers through a safety resistor. Under the structure mentioned above, a large quantity of recording sheets P each having images on its both sides were subjected to fixing collectively. As a result, neither the obverse side nor the reverse side showed thereon electric offset of static electricity. Though bias voltage of the absolute value of 200 V having the same polarity as that of toner was impressed in the example mentioned above, effects of the invention can be obtained by impressing voltage having the absolute value of 50–300 V.

Further, as another structure, the lower fixing roller is made to be conductive, and it is grounded, while the upper fixing roller is made to be insulating and its roller surface is charged positively by a corona charging unit or a roller charging unit. Under such structure, a transfer material having images on its both sides was subjected to fixing collectively. As a result, neither the obverse side nor the reverse side of the transfer material showed thereon electric offset of static electricity. The reason for this is assumed to be the following. Namely, since the lower fixing roller which is in pressure contact with the upper fixing roller is grounded, even when positive charges are transferred from the upper fixing roller to the lower fixing roller, the positive charges flow to the ground and thereby charging on the lower fixing roller is canceled.

As still another structure, the lower fixing roller was made to be conductive and was grounded, while the upper fixing roller was made to be conductive and was impressed with bias voltage of +200 V from the bias power source through a safety resistor. As a result, neither the obverse side nor the reverse side of a transfer material showed thereon electric offset of static electricity. The reason for this is considered to be the following. Namely, when the upper fixing roller is in pressure contact with the lower fixing roller, bias voltage impressed on the upper fixing roller leaks, but when a transfer material enters a gap between the rollers, positive bias voltage is impressed on the portion on the upper fixing roller where the transfer material passes due to insulating property of the transfer material and thereby offset of static electricity is prevented.

Though there has been explained the example wherein offset of static electricity is solved by providing an electric field forming means that forms an electric field between a fixing roller and a transfer material, the invention can offer the same effect even for the fixing unit employing a belt in place of a fixing roller as a fixing member.

Owing to the seventh structure of the invention, electric offset of static electricity can be solved completely and excellent image recording can be carried out for a long time in the image forming apparatus wherein toner images are formed on both sides of a transfer material and are fixed collectively, when an electric field forming means that forms an electric field is provided between a fixing member and a transfer material.

Further, the invention improves the tendency that image quality for one-sided image in the conventional image forming apparatus wherein toner images are formed on both sides of a transfer material and are fixed collectively tends to be inferior to that in a general image forming apparatus, and the invention makes it possible to solve electric offset of static electricity by switching between one-sided image recording and two-sided image recording, and thereby to control image forming so that excellent image forming may be carried out for a long time.

What is claimed is:

1. An image forming apparatus comprising:

(a) a first image carrier;

(b) a toner image forming device for forming a toner image on the first image carrier;

(c) a second image carrier onto which the toner image on the first image carrier is transferred and held, said second image carrier being provided opposite to the first image carrier;

(d) a first transferring device for transferring the toner image on the first image carrier onto a first side of a transfer material;

(e) a second transferring device for transferring the toner image on the second image carrier onto a second side of the transfer material;

(f) a fixing device for fixing the respective toner images transferred by the first and second transferring devices onto the first and second sides of the transfer material, respectively, said fixing device including: (1) a first fixing member provided opposite to the first side of the transfer material, (2) a second fixing member provided opposite to the second side of the transfer material such that the transfer material passes between the first and second fixing members, (3) a first sensor for detecting a temperature of the first fixing member, and (4) a second sensor for detecting a temperature of the second fixing member; and (g) a control device for controlling said toner image forming device, said first and second transferring devices, and said fixing device so as to enable said toner image forming device to selectively form the toner images on one of: (1) both the first and second sides of the transfer material, and (2) only one of the first and second sides of the transfer material, wherein when the temperature detected by the first sensor falls within a first predetermined temperature range set with respect to the first fixing member, and the temperature detected by the second sensor does not fall within a second predetermined temperature range set with respect to the second fixing member, said control device inhibits said toner image forming device from forming the toner images on both the first and second sides of the transfer material.

2. The image forming apparatus of claim 1, wherein said control device continuously enables said toner image forming device to form the toner images on only one of the first and second sides of transfer material.

3. The image forming apparatus of claim 1 further comprising a one-sided copy mode selector.

4. The image forming apparatus of claim 1 further comprising a two-sided copy mode selector, wherein when a two-sided copy mode is selected, said control device inhibits the toner image forming means from forming the toner images on both sides of the transfer material.

5. The image forming apparatus of claim 1, wherein the second predetermined temperature range set with respect to the second fixing member is not lower than the first predetermined temperature range set with respect to the first fixing member.

6. The image forming apparatus of claim 1, wherein when the temperature detected by the second sensor is less than the temperature range set with respect to the second fixing member, said control device enables the toner image forming device to form the toner images on both sides of the transfer material.

* * * * *